US009580947B1

(12) United States Patent
Amerling et al.

(10) Patent No.: US 9,580,947 B1
(45) Date of Patent: Feb. 28, 2017

(54) COWLS AND LATCHING ASSEMBLIES FOR COWLS ON OUTBOARD MARINE PROPULSION DEVICES

(71) Applicant: Brunswick Corporation, Lake Forest, IL (US)

(72) Inventors: Steven J. Amerling, Fond du Lac, WI (US); Timothy J. Eddy, Oshkosh, WI (US); Brad J. Van Ruiswyk, Waupun, WI (US); John D. Skroski, Oshkosh, WI (US); David B. Griep, Rubicon, WI (US); David M. Foulkes, Mequon, WI (US); Timothy R. Walters, Waupun, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/200,421

(22) Filed: Jul. 1, 2016

Related U.S. Application Data

(63) Continuation-in-part of application No. 14/871,298, filed on Sep. 30, 2015.
(Continued)

(51) Int. Cl.
*B63H 20/32* (2006.01)
*E05C 19/12* (2006.01)
(Continued)

(52) U.S. Cl.
CPC ..... *E05C 19/12* (2013.01); *B63H 20/32* (2013.01); *E05C 3/004* (2013.01); *E05C 3/124* (2013.01)

(58) Field of Classification Search
CPC ..... B63H 20/32; B63H 20/00
(Continued)

(56) References Cited

U.S. PATENT DOCUMENTS 2,549,483 A * 4/1951 Kiekhaefer ..... B63H 20/10 123/195 P
2,549,485 A * 4/1951 Kiekhaefer ..... B63H 20/10 123/195 P
(Continued)

FOREIGN PATENT DOCUMENTS

JP 424192 1/1992
JP 4231286 8/1992

OTHER PUBLICATIONS

Fuel-Door-Full_Open.jpg, http://www.iamaudi.com/img/Fuel-Door-Open, website visited Jul. 9, 2015.
(Continued)

*Primary Examiner* — Lars A Olson
*Assistant Examiner* — Jovon Hayes
(74) *Attorney, Agent, or Firm* — Andrus Intellectual Property Law, LLP

(57) ABSTRACT

A cowl for an outboard marine propulsion device having an internal combustion engine. The cowl comprises a first cowl portion; a second cowl portion that mates with the first cowl portion to enclose the internal combustion engine; a service door on the second cowl portion, wherein the service door is positionable in an open position and in a closed position; and a carrying handle on the second cowl portion, wherein the carrying handle is accessible when the service door is in the open position and inaccessible when the service door is in the closed position. A plurality of latches are spaced apart around the perimeter. The latches latch the second cowl portion to the first cowl portion. An actuator assembly actuates each of the plurality of latches. The actuator assembly can be actuated by movement of the carrying handle.

40 Claims, 17 Drawing Sheets

Related U.S. Application Data

(60) Provisional application No. 62/268,180, filed on Dec. 16, 2015.

(51) Int. Cl.
*E05C 3/12* (2006.01)
*E05C 3/00* (2006.01)

(58) Field of Classification Search
USPC ..... 440/77
See application file for complete search history.

(56) References Cited

U.S. PATENT DOCUMENTS 3,773,010 A * 11/1973 Elingsen ..... F02B 61/045 123/195 P
4,348,194 A * 9/1982 Walsh ..... F02B 61/045 123/195 P
4,600,396 A * 7/1986 Crane ..... F02B 61/045 292/247
RE32,620 E * 3/1988 Iwai ..... F02B 61/045 123/195 P
4,832,641 A * 5/1989 Oishi ..... F02B 61/045 123/195 P
4,844,031 A * 7/1989 Boda ..... F02B 61/045 123/195 P
4,875,883 A * 10/1989 Slattery ..... F02B 61/045 123/195 P
4,927,194 A * 5/1990 Wagner ..... E05C 3/045 292/106
5,102,358 A * 4/1992 Binversie ..... B63H 20/08 440/53
5,120,248 A * 6/1992 Daleiden ..... B63H 20/32 292/202
5,509,836 A * 4/1996 Ogasawara ..... B63H 20/00 440/76
5,868,591 A * 2/1999 Kleeman ..... B63H 20/00 114/172
6,059,619 A * 5/2000 Nozue ..... B63H 20/245 440/88 C
6,390,865 B1 * 5/2002 Kameoka ..... F02B 61/045 440/53
6,488,552 B2 * 12/2002 Kitsu ..... F02B 61/045 440/77
6,669,517 B1 * 12/2003 Alby ..... F02B 61/045 123/195 P
6,682,379 B1 * 1/2004 Walczak ..... B63H 20/32 123/195 P
6,899,579 B1 * 5/2005 Bruestle ..... B63H 20/002 440/77
7,201,623 B1 * 4/2007 Krupp ..... B63H 20/32 440/77
7,210,973 B2 * 5/2007 Sanschagrin ..... F02B 61/045 123/195 C
7,267,592 B1 * 9/2007 Ingebritson ..... B63H 20/32 123/195 P
7,448,928 B2 * 11/2008 Hasegawa ..... B63H 20/32 292/113
7,621,791 B2 * 11/2009 Yazaki ..... F02F 7/0082 440/77
2003/0054708 A1 * 3/2003 Yoshioka ..... B63H 20/08 440/53

OTHER PUBLICATIONS

Unpublished U.S. Appl. No. 14/721,106, filed May 26, 2015.

* cited by examiner

COWLS AND LATCHING ASSEMBLIES FOR COWLS ON OUTBOARD MARINE PROPULSION DEVICES

CROSS REFERENCE TO RELATED APPLICATION

The present application is a continuation-in-part of U.S. patent application Ser. No. 14/871,298, filed Sep. 30, 2015, which is hereby incorporated herein by reference in entirety. The present application also claims the benefit of Provisional U.S. Patent Application No. 62/268,180, filed Dec. 16, 2015, which is hereby incorporated herein by reference in entirety.

FIELD

The present disclosure relates to outboard marine propulsion devices and more particularly to cowls and latching devices for cowls on outboard marine engines.

BACKGROUND

U.S. patent application Ser. No. 14/721,106 is hereby incorporated herein by reference in entirety and discloses a latching apparatus for a cowl on an outboard marine engine. The cowl has a first cowl portion and a second cowl portion, which are latched together by the latching apparatus in a closed cowl position and unlatched from each other in an open cowl position. The latching apparatus comprises a retainer on the first cowl portion; an actuator device on the second cowl portion; and a wire coupled to the actuator device. The wire is coupled to the retainer in the closed cowl position and the wire is uncoupled from the retainer in the open cowl position. Actuation of the actuator device in a first direction rotates the wire so as to couple the wire to the retainer and actuation of the actuator device in a second direction rotates the wire so as to uncouple the wire from the retainer.

U.S. Pat. No. 4,348,194 is hereby incorporated herein by reference in entirety and discloses a cowl for the power head of an outboard motor that includes two bottom cowl members attached together by screws which also mount a latch bracket and a hinge member. The latch bracket supports a latch mechanism which, with the hinge member serves to hold a top cowl member in place.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a cowl is for an outboard marine propulsion device having an internal combustion engine. The cowl comprises a first cowl portion and a second cowl portion that mates with the first cowl portion to enclose the internal combustion engine. A service door is on the second cowl portion. The service door is positionable in an open position and in a closed position. A carrying handle is on the second cowl portion. The carrying handle is accessible when the service door is in the open position and inaccessible when the service door is in the closed position.

In certain examples, the carrying handle is movable between a retracted position and an extended position. In the extended position, the carrying handle is located for manual grasping by a user. In certain examples, in the extended position, the carrying handle is located over the center of gravity of the second cowl portion to thereby facilitate manual lifting and carrying of the second cowl portion via the carrying handle.

In certain examples, the second cowl portion mates with the first cowl portion along a perimeter to enclose the internal combustion engine. A plurality of latches are spaced apart around the perimeter and latch the second cowl portion to the first cowl portion. An actuator assembly actuates each of the plurality of latches. In certain examples, the actuator assembly comprises a rotary actuator assembly that includes a plurality of pulleys and a plurality of flexible connectors. Each latching device in the plurality of latching devices is connected to a pulley of the plurality of pulleys. Each pulley of the plurality of pulleys is connected to at least two flexible connectors of the plurality of flexible connectors. The plurality of flexible connectors together form a loop that extends from an outgoing side of the rotary actuator assembly to an incoming side of the rotary actuator assembly.

BRIEF DESCRIPTION OF THE DRAWINGS

The present disclosure is described with reference to the following Figures. The same numbers are used throughout the figures to reference like features and like components.

DETAILED DESCRIPTION OF THE DRAWINGS

Figure 1:
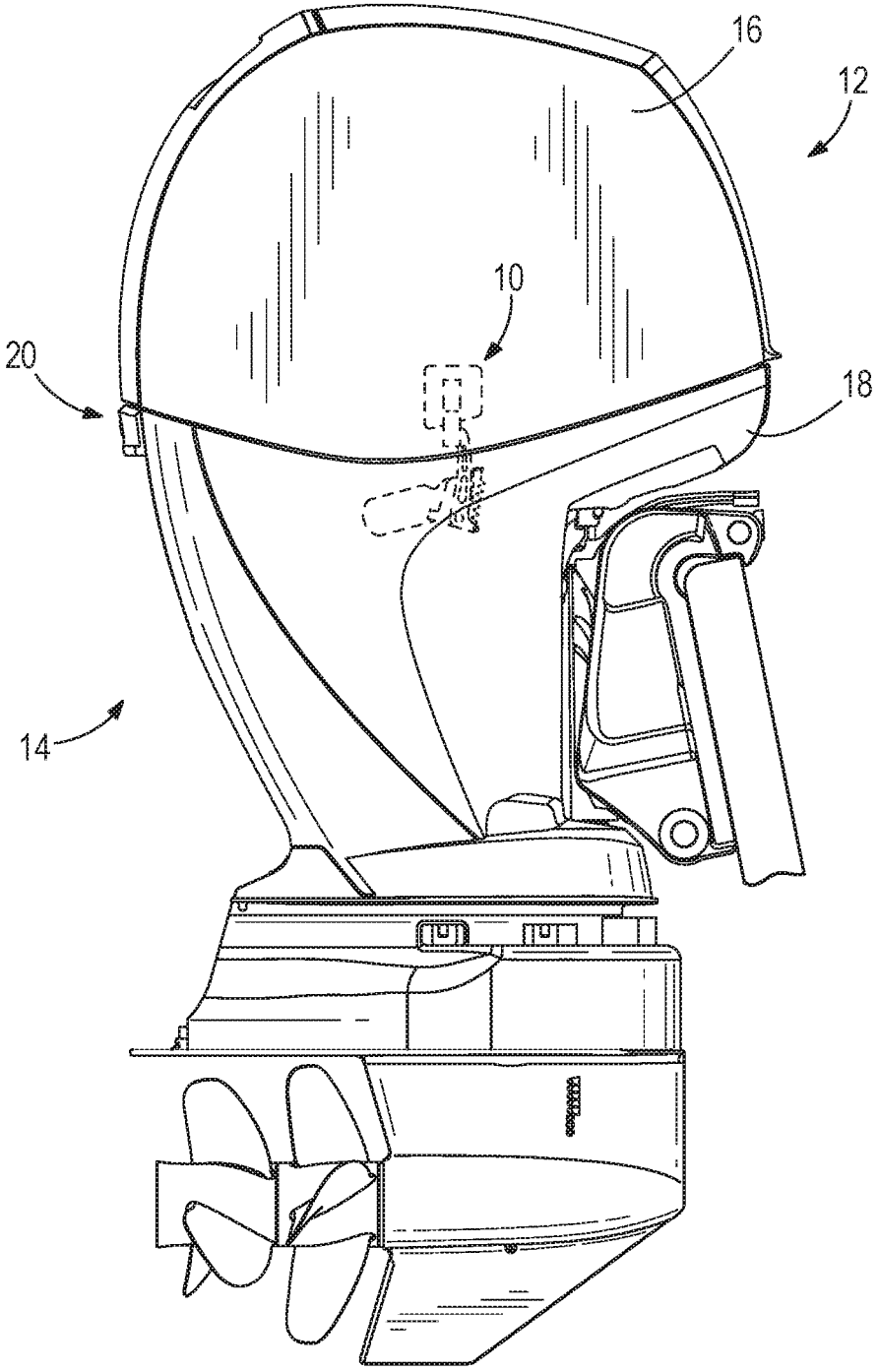
FIG. 1 is a side view of an outboard marine engine having a cowl held in a closed cowl position by a latching device shown in dashed lines.

FIG. 1 depicts a latching device 10 for a cowl 12 on an outboard marine engine 14. The cowl 12 has first and second cowl portions 16, 18 that are separated from each other in an open cowl position (not shown) and that are latched together by the latching device 10 in a closed cowl position (FIG. 1). The type and configuration of the cowl 12 and outboard marine engine 14 can vary from that which is shown in the figures. In the illustrated example, the first cowl portion 16 is a top cowl and the second cowl portion 18 is a lower cowl or "chaps"; however the latching device 10 could also be arranged so that the first cowl portion 16 is the lower cowl and the second cowl portion 18 is the top cowl.

Figure 2:
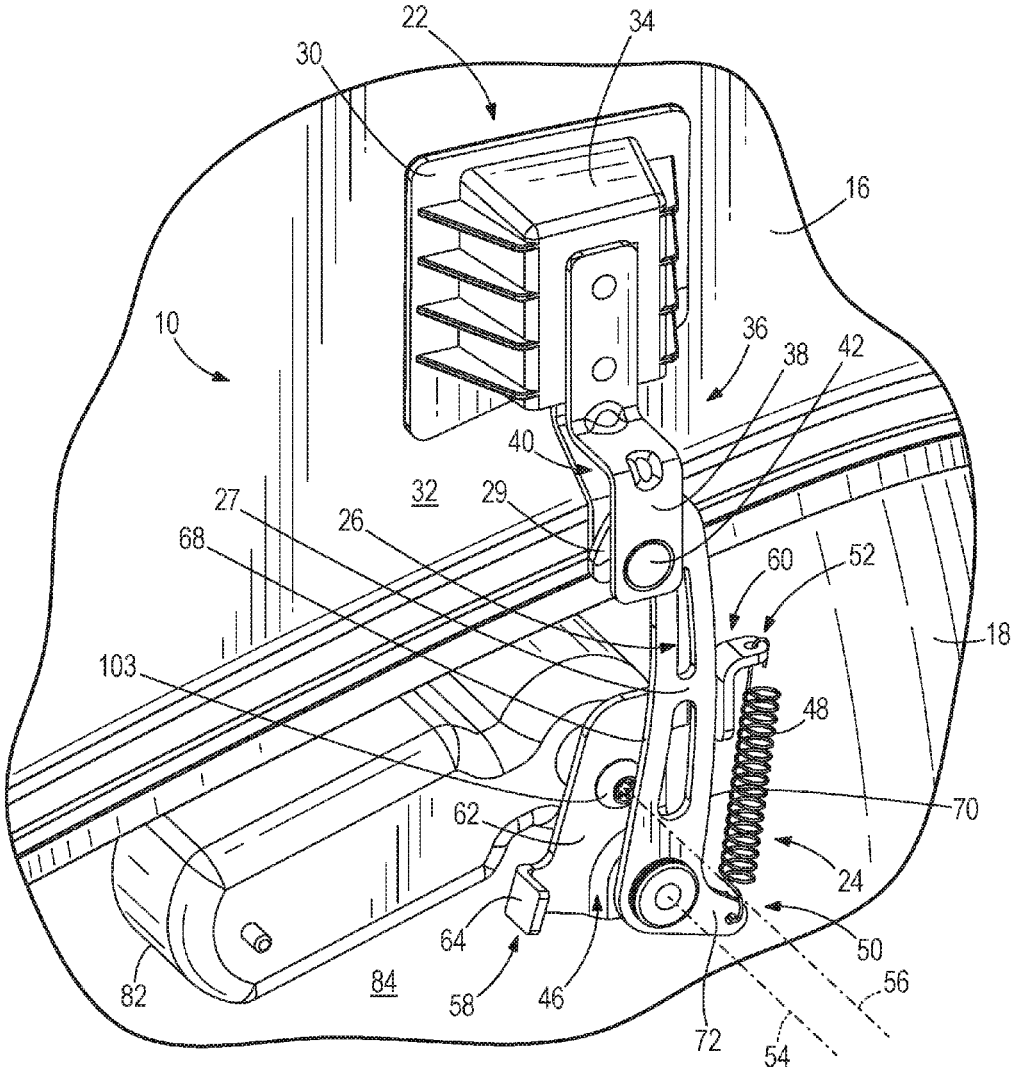
FIG. 2 is a perspective view of the latching device on the interior of the cowl.
Figure 3:
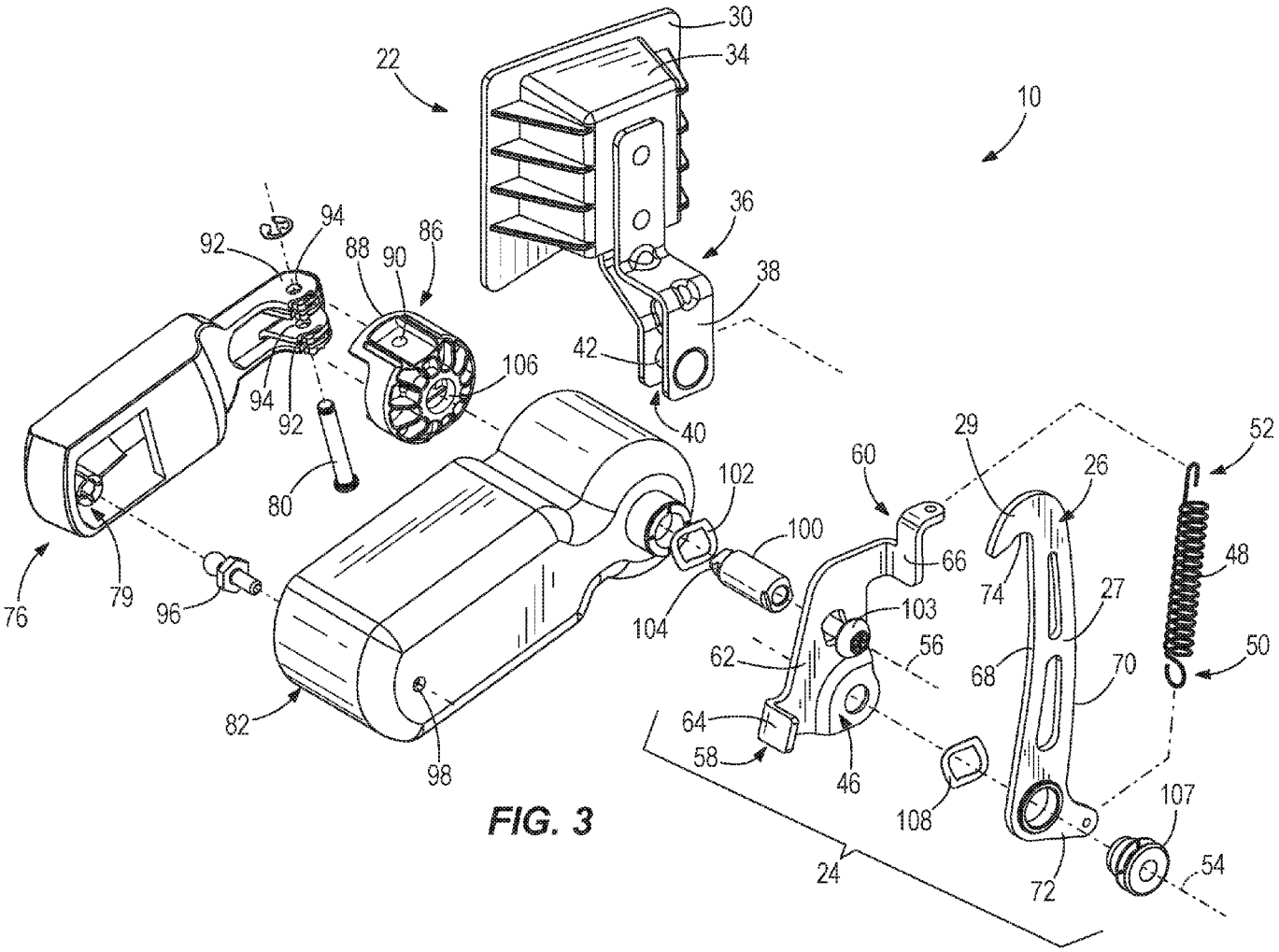
FIG. 3 is an exploded perspective view of the latching device.
Figure 4:
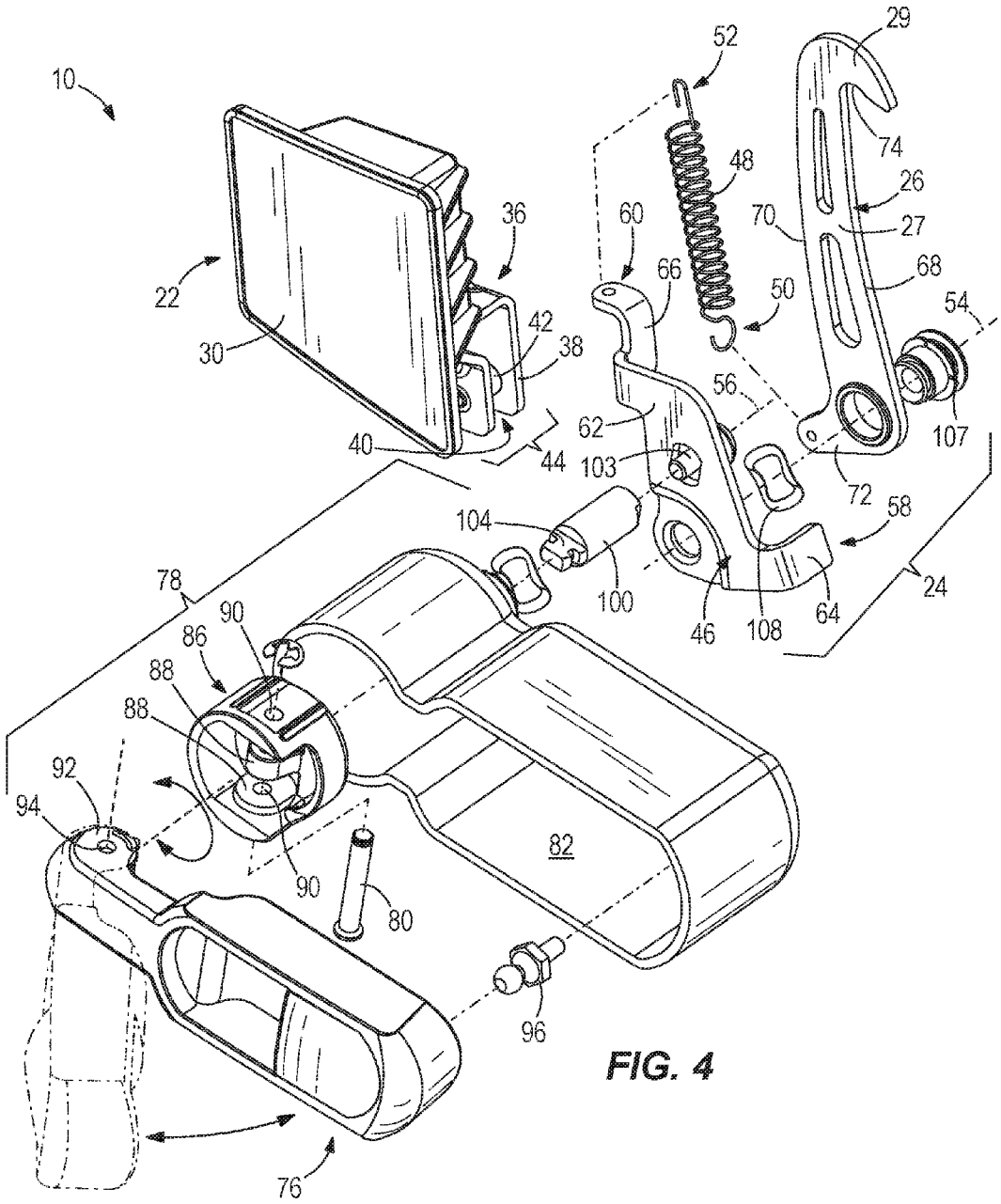
FIG. 4 is another exploded perspective view of the latching device.

Referring to FIGS. 2-4, the latching device 10 has a retainer 22 that is affixed to the first cowl portion 16 and a latch 24 that is affixed to the second cowl portion 18. The latch has an engagement member 26 that is rotatable into and between a latched position (FIG. 2) in which the engagement member 26 is engaged with the retainer 22 to retain the first and second cowl portions 16, 18 in the closed cowl position and an unlatched position (FIG. 5) in which the engagement member 26 is disengaged from the retainer 22 to allow movement of the first and second cowl portions 16, 18 into the open cowl position. As described further herein below with reference to FIGS. 5-9, the latch 24 is uniquely configured such that an overcenter force acts on the engagement member 26 as the latch 24 is moved from the unlatched position to the latched position and vice versa. Advantageously, the overcenter force assists the engagement member 26 towards the unlatched and latched positions.

The type and configuration of the retainer 22 can vary from that which is shown. In the illustrated example, the retainer 22 includes a base plate 30 that is affixed to an interior surface 32 of the first cowl portion 16. The retainer 22 further includes a mounting block 34 on the base plate 30 and a mounting bracket 36 on the mounting block 34. The mounting block 34 and mounting bracket 36 can be formed together or as different components. The mounting bracket 36 includes a pair of aligned offset bracket portions 38, 40 and a supporting shaft 42 that extends between the pair of aligned offset bracket portions 38, 40 such that a gap 44 (see FIG. 4) exists therebetween. The gap 44 allows for passage of the engagement member 26 into and out of engagement with the supporting shaft 42, as will be described further herein below.

In addition to the engagement member 26, the latch 24 includes a bell crank 46 that causes and assists rotation of the engagement member 26 into and out of the latched position and unlatched position. The latch 24 also has a coil spring 48 with a first end 50 that is coupled to the engagement member 26 and a second end 52 that is coupled to the bell crank 46. The coil spring 48 has a natural resiliency so that the coil spring 48 tends to axially contract. The concepts herein disclosed are not limited to arrangements having a coil spring. For example, spring 48 can instead be a torsion spring as described herein below with reference to FIGS. 10-20.

The engagement member 26 rotates about an engagement member axis of rotation 54. The bell crank 46 rotates about a bell crank axis of rotation 56. At certain points, as described herein below, the engagement member 26 translates about the bell crank axis of rotation 56 as the bell crank 46 rotates about the bell crank axis of rotation 56. The engagement member axis of rotation 54 and the bell crank axis of rotation 56 are parallel to each other and are laterally spaced apart from each other. The engagement member 26 has an elongated engagement arm 27 and a transverse end 29 that engages with and disengages from the retainer 22, as will be further described herein below. The engagement member 26 has opposing first and second engagement surfaces 68, 70. The engagement member 26 along the transverse end 29 has an inner engagement surface 74 (see FIGS. 3 and 4) that transversely extends relative to the first engagement surface 68.

The bell crank 46 has a first engagement portion 58 that engages with and assists rotation of the engagement member 26 as the bell crank 46 is rotated about the bell crank axis of rotation 56 in an unlatching direction (compare FIGS. 9 through 5; as further discussed herein below). The bell crank 46 further has a second engagement portion 60 that engages with and retains the engagement member 26 in the latched position as the bell crank 46 is rotated with respect to the engagement member 26 about the bell crank axis of rotation 56 in an opposite, latching direction (compare FIGS. 5 through 9; as further discussed herein below), wherein the engagement member 26 is safely held in place, as will be described further herein below. The exact configuration of the bell crank 46 can vary from that which is shown. In the illustrated example, the bell crank 46 includes a plate 62. The first engagement portion 58 includes a first flange 64 that transversely extends relative to the plate 62. The second engagement portion 60 includes a second flange 66 that transversely extends relative to the plate 62. The first and second flanges 64, 66 are disposed on opposite sides of the plate 62 with respect to the engagement member 26 and in use engage with the first and second engagement surfaces 68, 70, respectively. The first end 50 of the coil spring 48 is attached to a lateral extension 72 of the engagement member 26. The opposite, second end 52 of the coil spring 48 is attached to the second engagement portion 60 of the bell crank 46.

As further described herein below with respect to FIGS. 5-9, rotation of the bell crank 46 in the latching direction (shown at arrow 110) initially causes the bell crank 46 and engagement member 26 to rotate together, due to the resiliency of the coil spring 48, until the first engagement surface 68 abuts the supporting shaft 42. Continued rotation of the bell crank 46 in the latching direction causes the bell crank 46 to translate with respect to the engagement member 26, as the first engagement surface 68 slides down along the supporting shaft 42, until the inner engagement surface 74 engages with the supporting shaft 42 and the second flange 66 abuts the second engagement surface 70. Conversely, comparing FIGS. 9-5, rotation of the bell crank 46 in the opposite unlatching direction (oppositely of arrow 110) initially causes the inner engagement surface 74 to separate from the supporting shaft 42 on the retainer 22 while the first engagement surface 68 slides upwardly along and continues to abut the supporting shaft 42. Continued rotation of the bell crank 46 in the unlatching direction causes the first engagement portion 58 to engage the first engagement surface 68 of the engagement member 26 and thus cause the engagement member 26, including the inner engagement surface 74 and the first engagement surface 68, to rotate away from the supporting shaft 42 of the retainer 22 about the bell crank axis of rotation 56. In the unlatched position, the resiliency of the coil spring 48 tends to maintain relative positions of the bell crank 46 and engagement member 26, as shown in FIG. 5.

Rotation of the latch 24 can be caused by various known arrangements. In the illustrated example, which is unique, the latching device 10 has a handle 76 that is attached to the bell crank 46 along the bell crank axis of rotation 56 such that rotation of the handle 76 about the bell crank axis of rotation 56 causes rotation of the bell crank 46 about the bell crank axis of rotation 56. The handle 76 is attached to the bell crank 46 by a handle retainer assembly 78 (FIG. 4). The handle retainer assembly 78 is configured such that the handle 76 is movable (in the illustrated example, pivotable) into and between a rotationally fixed position (see e.g. FIG. 4; solid line) wherein the handle 76 is prevented from rotating about the bell crank axis of rotation 56 and a rotatable position (see e.g. FIG. 4; phantom line) wherein the handle 76 is rotatable about the bell crank axis of rotation 56. The handle 76 is pivotable about a handle pivot shaft 80 that extends transversely to the bell crank axis of rotation 56. A handle retainer 82 is formed in or attached to the interior surface 84 of the second cowl portion 18. The handle retainer 82 houses the handle 76 when the handle 76 is in the noted rotationally fixed position. The handle 76 is pivoted about the handle pivot shaft 80 to remove the handle 76 from the handle retainer 82 (FIG. 4; phantom line). A clevis housing 86 supports opposite ends of the handle pivot shaft 80. The clevis housing 86 has clevis ears 88 that each has a throughbore 90 that receives a respective end of the handle pivot shaft 80. The handle 76 has handle ears 92 that each has a throughbore 94 that receive a respective end of the handle pivot shaft 80. An axial alignment pin 96 is secured in aperture 98 of handle retainer 82. Formed in the handle 76 is a retainer 79 that receives the ball end of the axial alignment pin 96 in a snap fit and thus aligns and secures position of the handle 76 with respect to the handle retainer 82.

Referring to FIGS. 2 and 3, a bell crank pivot shaft 100 axially extends along the bell crank axis of rotation 56 and connects the bell crank 46 to the handle 76 via the clevis housing 86 such that the handle 76, clevis housing 86, bell crank pivot shaft 100 and bell crank 46 rotate together about the bell crank axis of rotation 56 when the handle 76 is rotated about the bell crank axis of rotation 56. A fastener 103 connects the bell crank 46 to the bell crank pivot shaft 100 such that the bell crank 46 and bell crank pivot shaft 100 rotate together about the bell crank axis of rotation 56. A Belleville washer 102 is disposed between the opposite end of the bell crank pivot shaft 100 and the handle retainer 82. The Belleville washer 102 has curvatures that tend to axially separate the bell crank 46 from the handle retainer 82 and thus allow free rotation of the bell crank 46 with respect to the handle retainer 82. A T-shaped or flanged extension 104 axially extends from the end of the bell crank pivot shaft 100 and is received in a complementary shaped recess 106 formed in the clevis housing 86 such that the clevis housing 86 and associated handle 76 rotate together with the bell crank pivot shaft 100 and bell crank 46 about the bell crank axis of rotation 56. A bushing fastener 107 connects the engagement member 26 to the bell crank 46 along the engagement member axis of rotation 54. A Belleville washer 108 is disposed between the engagement member 26 and the bell crank 46. The Belleville washer 108 has curvatures that tend to axially separate the engagement member 26 and the bell crank 46 so that the bell crank 46 and engagement member 26 are freely rotatable with respect to each other about the engagement member axis of rotation 54.

Figure 5:
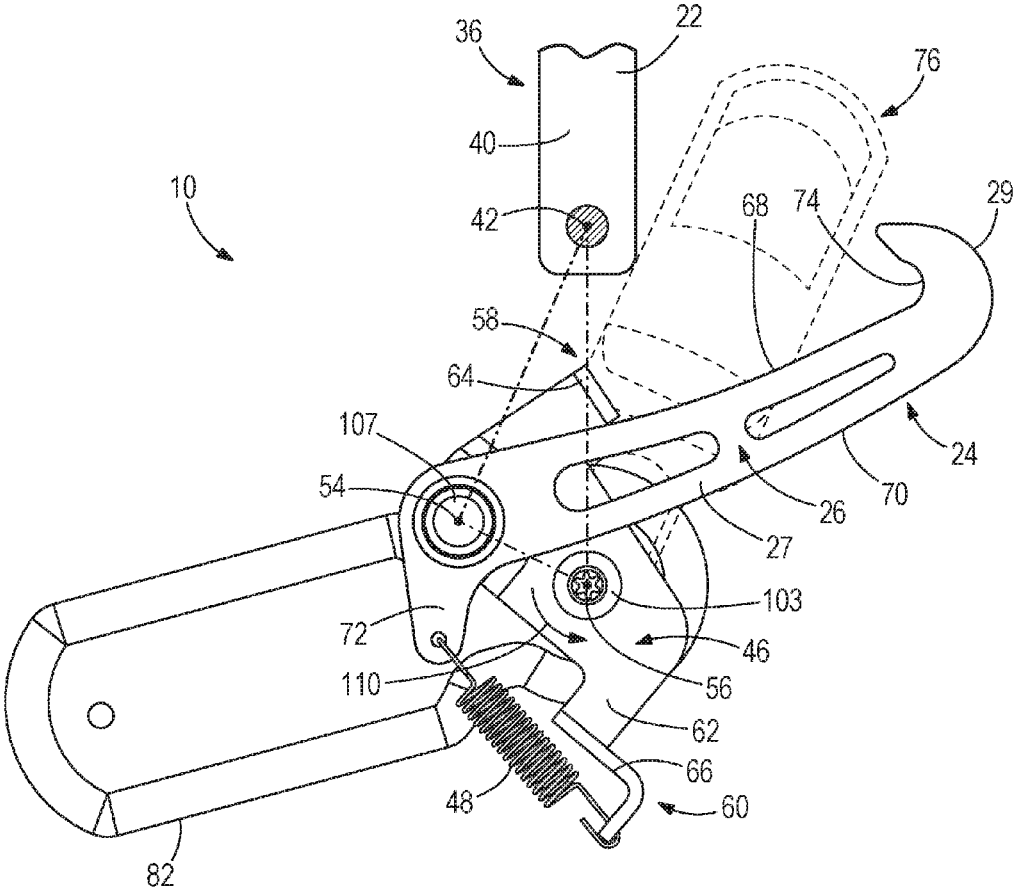
FIGS. 5-9 are side views of the latching device showing movement of the latching device from an unlatched position (FIG. 5) to a latched position (FIG. 9).
Figure 6:
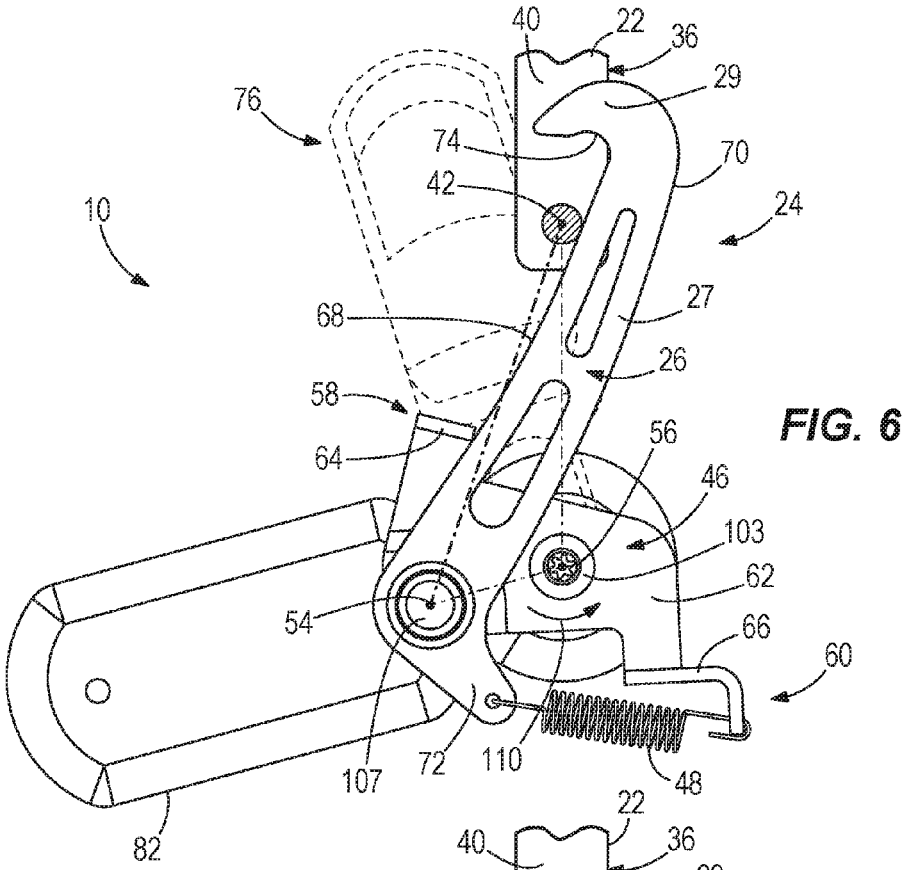
Figure 7:
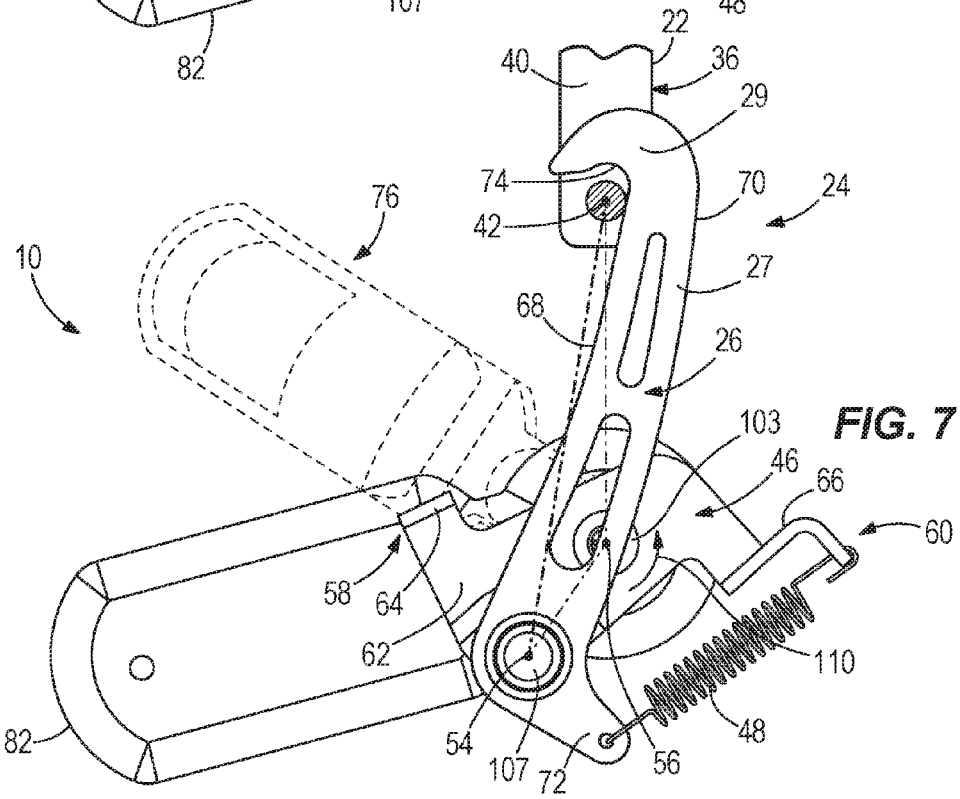
Figure 8:
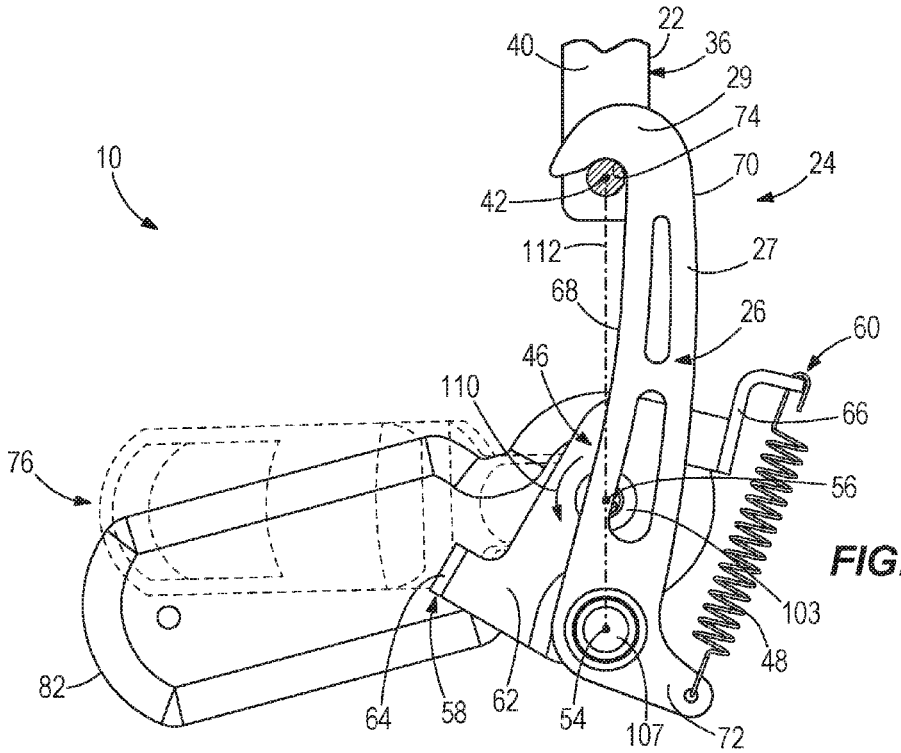
Figure 9:
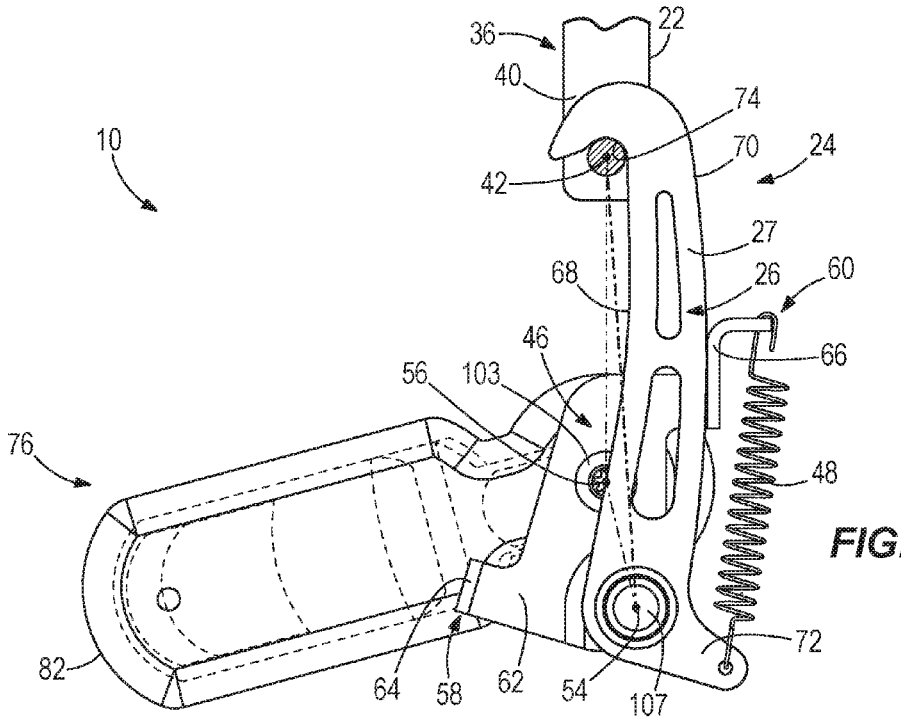

Referring now to FIGS. 5-9, movement of the latching device 10 will be described. FIG. 5 depicts the latching device 10 in the unlatched position and FIG. 9 depicts the latching device 10 in the latched position. FIGS. 6-8 depict movement of the latching device 10 from the unlatched position to the latched position. The handle 76 is shown in dashed lines. Comparing FIG. 5 to FIG. 6, to initiate latching of the latching device 10, the handle 76 when viewed from inside the cowl 12 as shown in FIG. 5, is rotated in the counterclockwise direction, as shown at arrow 110, about the bell crank axis of rotation 56, which in turn causes counterclockwise rotation of the bell crank pivot shaft 100 and bell crank 46. Due to the tendency of the coil spring 48 to retract, the engagement member 26 rotates along with the bell crank 46 in the counterclockwise direction about the bell crank axis of rotation 56 until the first engagement surface 68 engages with the supporting shaft 42, as shown in FIG. 6. Now comparing FIG. 6 to FIG. 7, continued rotation of the handle 76 in the counterclockwise direction causes continued counterclockwise rotation of the bell crank pivot shaft 100 and bell crank 46, however the supporting shaft 42 prevents further counterclockwise rotation of the engagement member 26. Thus as the bell crank 46 is rotated about bell crank axis of rotation 56, the coil spring 48 is caused to extend as the distance between the second engagement portion 60 and the lateral extension 72 increases. Further counterclockwise rotation of the bell crank 46 with respect to the engagement member 26 translates the engagement member axis of rotation 54 with respect to the bell crank axis of rotation 56, which causes the coil spring 48 to further extend, and the engagement member 26 to move with respect to the supporting shaft 42 (downwardly in the figure) such that the first engagement surface 68 slides downwardly along the supporting shaft 42. As shown by comparison of FIG. 7 to FIG. 8, further counterclockwise rotation of the handle 76 causes the first engagement surface 68 to continue to slide along the supporting shaft 42 until the inner engagement surface 74 engages with the supporting shaft 42, as shown in FIG. 8. At this point, the bell crank 46 is in a centered position. Thereafter, as shown by comparison of FIGS. 8 and 9, continued rotation of the handle 76 in the counterclockwise direction (arrow 110) causes the bell crank pivot shaft 100 and bell crank 46 to rotate relative to the engagement member 26 until the second engagement portion 60 including the second flange 66 engages with the second engagement surface 70 of the engagement member 26.

FIG. 9 thus depicts the bell crank 46 and engagement member 26 in an overcenter position. The overcenter position shown in FIG. 9 corresponds to the closed cowl position shown in FIG. 1. In the closed cowl position, separating forces on the first and/or second cowl portions 16, 18 tend to separate the first and second cowl portions 16, 18. These separating forces can be caused by, for example, the natural resiliency of a conventional gasket seal disposed between the first and second cowl portions 16, 18, or by some other bumper and/or similar structure. The separating forces cause the latching device 10 to stay in the overcenter position shown in FIG. 9, such that the overcenter force retains the latching device 10 in the latched position. This advantageously safely retains the latching device 10 in the latched position, wherein the inner engagement surface 74 is engaged with the supporting shaft 42 and the second flange 66 of the bell crank 46 abuts the second engagement surface 70 of the engagement member 26. Opposite rotation of the handle 76 is required to overcome the overcenter force and thus unlatch the latching device.

Comparing FIGS. 5 and 6, initial rotation of the handle 76, bell crank pivot shaft 100 and bell crank 46 in the direction of arrow 110 also causes rotation of the engagement member 26, which is attached to the bell crank 46 at the bushing fastener 107 and via the coil spring 48. The resiliency of the coil spring 48 causes the bell crank 46 and engagement member 26 to rotate together about the bell crank pivot shaft 100. As shown by comparison of FIGS. 6 and 7, engagement of the engagement member 26 with the supporting shaft 42 prevents the engagement member 26 and bell crank 46 from rotating together, which causes extension of the coil spring 48, as described herein above. As shown by comparison of FIGS. 6, 7 and 8, the bell crank 46 moves toward the centered position, shown in FIG. 8, wherein the bell crank axis of rotation 56 is disposed linearly between the engagement member axis of rotation 54 and supporting shaft 42, as shown at line 112. As shown by comparison of FIGS. 8 and 9, continued counterclockwise rotation of the handle 76 moves the engagement member axis of rotation 54 past and out of alignment with the supporting shaft 42 and bell crank axis of rotation 56 and into the noted overcenter position.

As discussed herein above, in the latched position, the handle 76 is pivoted about the handle pivot shaft 80 to insert the handle 76 into the handle retainer 82 until the ball end of axial alignment pin 96 extends through and snap-fit engages with the retainer 79, thus securing the handle 76 in place.

It will be understood by one having ordinary skill in the art that the latching procedure described herein above with reference to FIGS. 5-9 is undertaken in reverse order to unlatch latching device 10. It will be understood by one having ordinary skill in the art that as the handle 76 is rotated in the clockwise direction (opposite the arrow 110), the coil spring 48 contracts and helps retain the engagement member 26 and bell crank 46 in the position shown in FIGS. 5 and 6.

The present disclosure thus provides a cowl 12 and a latching device 10 for a cowl 12 on an outboard marine engine 14, the cowl 12 having first and second cowl portions 16, 18 that are separated from each other in an open cowl position and that are latched together by the latching device 10 in a closed cowl position. In certain examples, the latching device 10 includes a retainer 22 adapted to be fixed to the first cowl portion 16 and a latch 24 adapted to be fixed to the second cowl portion 18. The latch 24 is movable into and between a latched position (FIG. 9) in which the latch 24 is latched to the retainer 22 and an unlatched position (FIG. 5) in which the latch 24 is unlatched from the retainer 22. The latch 24 includes an engagement member 26, a bell crank 46, and a spring 48 that is coupled to the bell crank 46 and the engagement member 26. Movement of the latch 24 towards the latched position causes the engagement member 26 to engage the retainer 22 (FIG. 6). Further movement of the latch 24 towards the latched position causes the bell crank 46 to move with respect to the engagement member 26, which causes the engagement member 26 to latch to the retainer 22 (FIGS. 7-9). Movement of the latch 24 away from the latched position causes the bell crank 46 to move the engagement member 26, which causes the engagement member 26 to unlatch from the retainer 22 (compare FIGS. 9-7). Further movement of the latch 24 away from the latched position causes the engagement member 26 to separate from the retainer 22 (FIG. 5).

The bell crank 46 rotates about the bell crank axis of rotation 56. The engagement member 26 rotates about the engagement member axis of rotation 54. The engagement member axis of rotation 54 and bell crank axis of rotation 56 are parallel to each other and are laterally spaced apart from each other (see FIG. 2). Movement of the bell crank 46 with respect to the engagement member 26 acts against the spring 48 as the bell crank 46 passes by a centered position (see FIG. 8, dashed line). The coil spring 48 acts to retain the bell crank 46 and engagement member 26 in a rotational position with respect to each other (e.g. FIG. 5 and FIG. 9) when the latch 24 is in the unlatched position and in the latched position. In certain examples, the spring 48 can be a coil spring that has a first end 50 coupled to the engagement member 26 and a second end 52 coupled to the bell crank 46. In other examples the spring 48 can be a torsion spring and/or the like.

Separation forces between the first cowl portion 16 and the second cowl portion 18 keep the latching device 10 in the latched position (FIG. 9). Advantageously, the latching device 10 allows a greater stroke and reduces handle load when compared to the prior art. The bell crank 46 provides a relatively large amount of stroke as it starts its pull-down motion (typically low load) and then creates a mechanical advantage at the centered position (FIG. 8). Advantageously, the bell crank 46 creates the desired motion of the engagement member 26 and provides redundant safety locking mechanisms via the overcenter force along with allowing for a large pull-down motion and low, smooth force. Advantageously, the latching device 10 has a long draw combined with low effort to provide improved latching and a smoother feel than the prior art. Advantageously, the latching device 10 provides a safety locking mechanism via locking engagement between the handle 76 and axial alignment pin 96 and abutment of second engagement surface 70 against second flange 66 of the bell crank 46.

FIGS. 10-20 depict another example of a cowl 200 for an outboard marine propulsion device and a latching assembly 202 for the cowl 200. The latching assembly 202 includes an actuator assembly 302 and a plurality of latching devices 204 that are similar to the latching device 10 shown in FIGS. 1-9, with a few exceptions.

Figure 10:
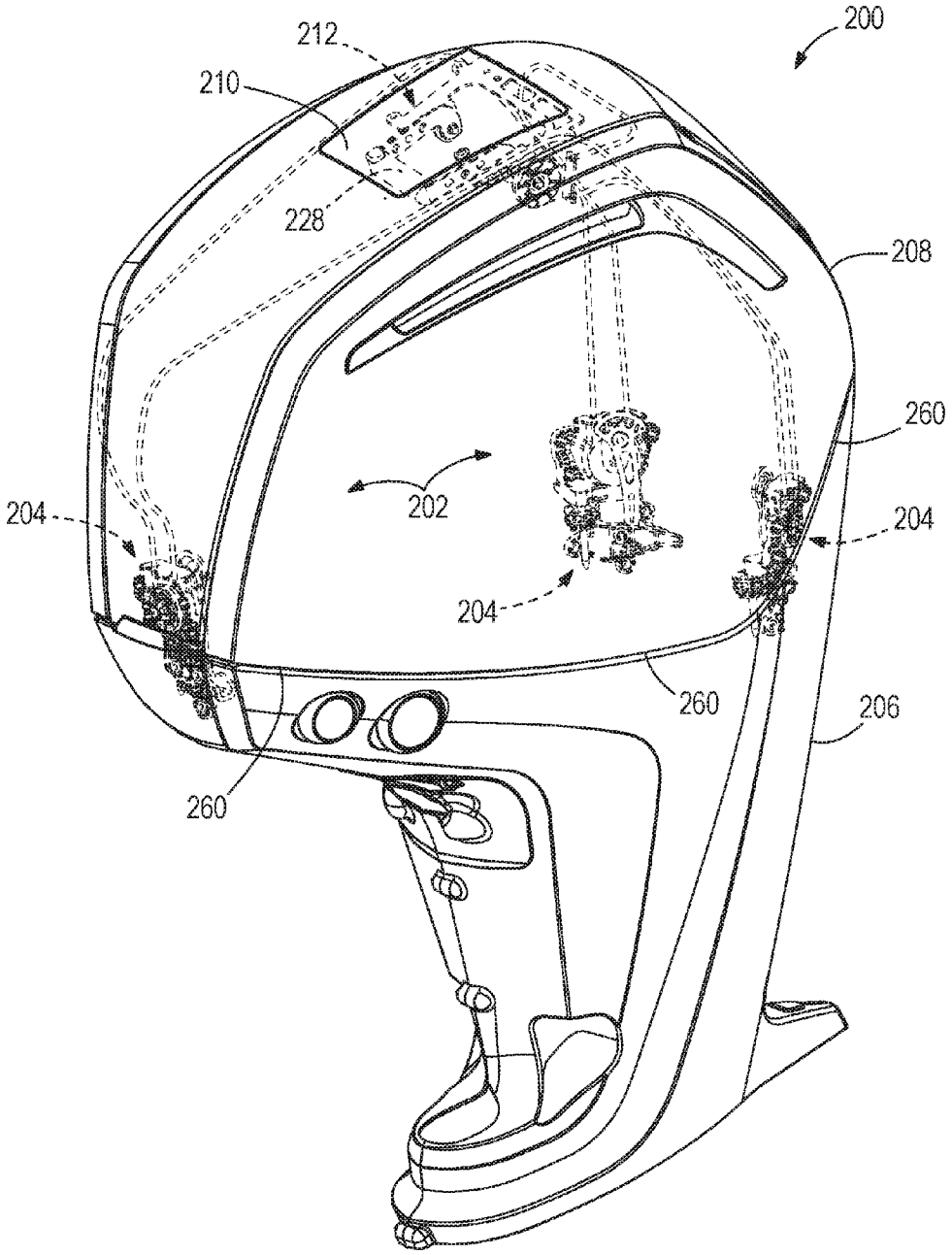
FIG. 10 is a perspective view of another example of a cowl for an outboard marine propulsion device held in a closed cowl position by a latching assembly shown in dashed line.

Similar to the embodiment shown in FIGS. 1-9, the cowl 200 encloses an internal combustion engine (not shown). The cowl 200 has a first cowl portion 206 and a second cowl portion 208 that mates with the first cowl portion 206 in a closed cowl position to enclose the noted internal combustion engine. A service door 210 on the second cowl portion 208 is positionable in an open position (FIGS. 11 and 12) and a closed position (FIG. 10). A carrying handle 212 is disposed on the second cowl portion 208. The carrying handle 212 is accessible when the service door 210 is in the open position (FIGS. 11 and 12) and inaccessible when the service door 210 is in the closed position (FIG. 10). Each latching device 204 could be arranged so that the first cowl portion and second cowl portion are reversed as the second cowl portion and the first cowl portion, respectively.

A locking mechanism 213 locks the service door 210 in the closed position. In the illustrated example, the locking mechanism 213 is a spring-actuated latch mechanism configured such that pressing down on the service door 210 causes the locking mechanism 213 to lock the service door 210 in the closed position and subsequently pressing on the service door 210 causes the locking mechanism 213 to unlock the service door 210 from the closed position wherein the service door 210 is free to pivot into the open position. The locking mechanism 213 has a push plate 211 on an interior surface 217 of the service door 210 that actuates a spring-loaded pin latch device 221 when the service door 210 is manually pressed. This type of locking mechanism is conventional. Other suitable locking mechanisms, including other types of push-to-open, push-to-close locking mechanisms, could instead be employed.

The carrying handle 212 is disposed in a pocket 214 formed in the second cowl portion 208. In the closed position (FIG. 10), the service door 210 closes the pocket 214 to thereby enclose the carrying handle 212 in the pocket 214. The noted internal combustion engine also has an oil dipstick with a dipstick handle 216 (FIG. 11) and an associated elongated dipstick shaft (not shown) that extends adjacent to an oil-fill tube and associated plug 215 on the internal combustion engine. Conveniently, the plug 215 and dipstick handle 216 are also disposed in the pocket 214 and are exposed with service door 210 in the open position (FIG. 11) for manual grasping by the user, thereby facilitating a check of an amount of oil in the internal combustion engine and fill of oil, as necessary. Closing the service door 210 encloses the dipstick handle 216 in the pocket 214.

Figure 11:
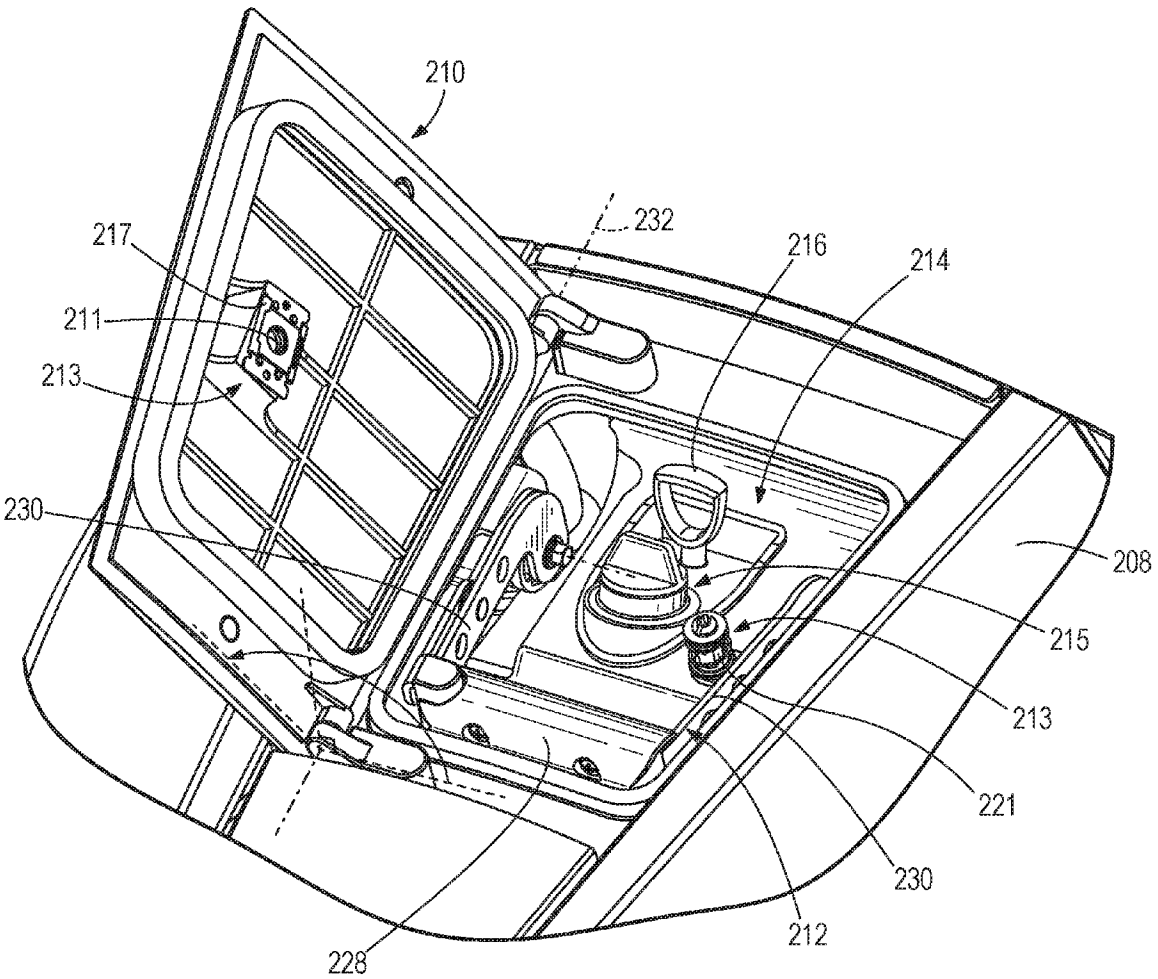
FIG. 11 is a perspective view of a service door and a carrying handle on the cowl shown in FIG. 10.
Figure 12:
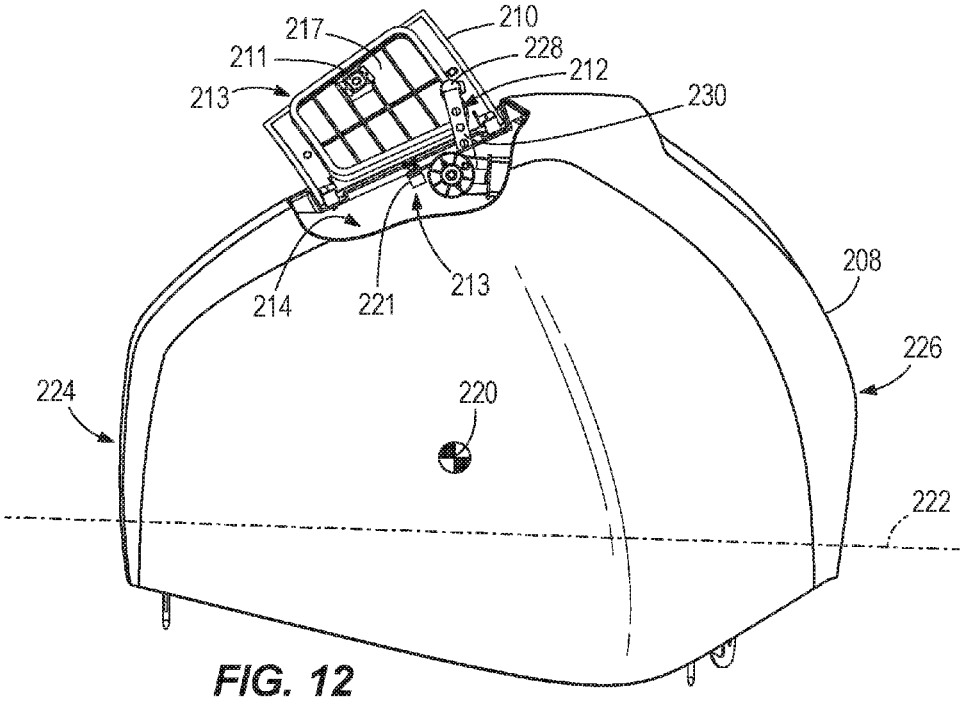
FIG. 12 is a side view, partially cut away, of the cowl, service door, and carrying handle shown in FIG. 11.

The carrying handle 212 is movable between a retracted position (FIG. 11) wherein the carrying handle 212 is retracted into the pocket 214 and an extended position (FIG. 12) wherein the carrying handle 212 extends from the pocket 214 for manual grasping by a user. In the extended position, the carrying handle 212 is positioned over the center of gravity 220 of the second cowl portion 208 to thereby advantageously facilitate manual lifting and carrying of the second cowl portion 208 via the carrying handle 212. The second cowl portion 208 extends along an axis 222 (FIG. 12) from a forward side 224 to an aftward side 226. The carrying handle 212 has a handlebar 228 and opposing arms 230 that support the handlebar 228 with respect to the second cowl portion 208. The handlebar 228 extends transversely to the axis 222. As shown in FIG. 11, the service door 210 is pivotable into and out of the open position about a pivot axis 232. Advantageously, the service door 210 is configured to pivot past a position perpendicular to the outer surface of the second cowl portion 208 so that the service door 210 is pivoted away from the carrying handle 212 and does not obstruct the user manually grasping the carrying handle 212.

Referring now to FIGS. 14-17, a locking mechanism 234 locks the carrying handle 212 in the extended position (FIG. 17) when the carrying handle 212 is pivoted from the retracted position (FIG. 15) to the extended position and also locks the carrying handle 212 in the retracted position when the carrying handle 212 is pivoted from the extended position to the retracted position. In the illustrated example, the locking mechanism 234 includes a pawl 236 and a ratchet gear 238. A pushbutton 240 is configured to release the pawl 236 from the ratchet gear 238 and thus allow the carrying handle 212 to pivot into and out of the retracted position and the extended position.

Figure 14:
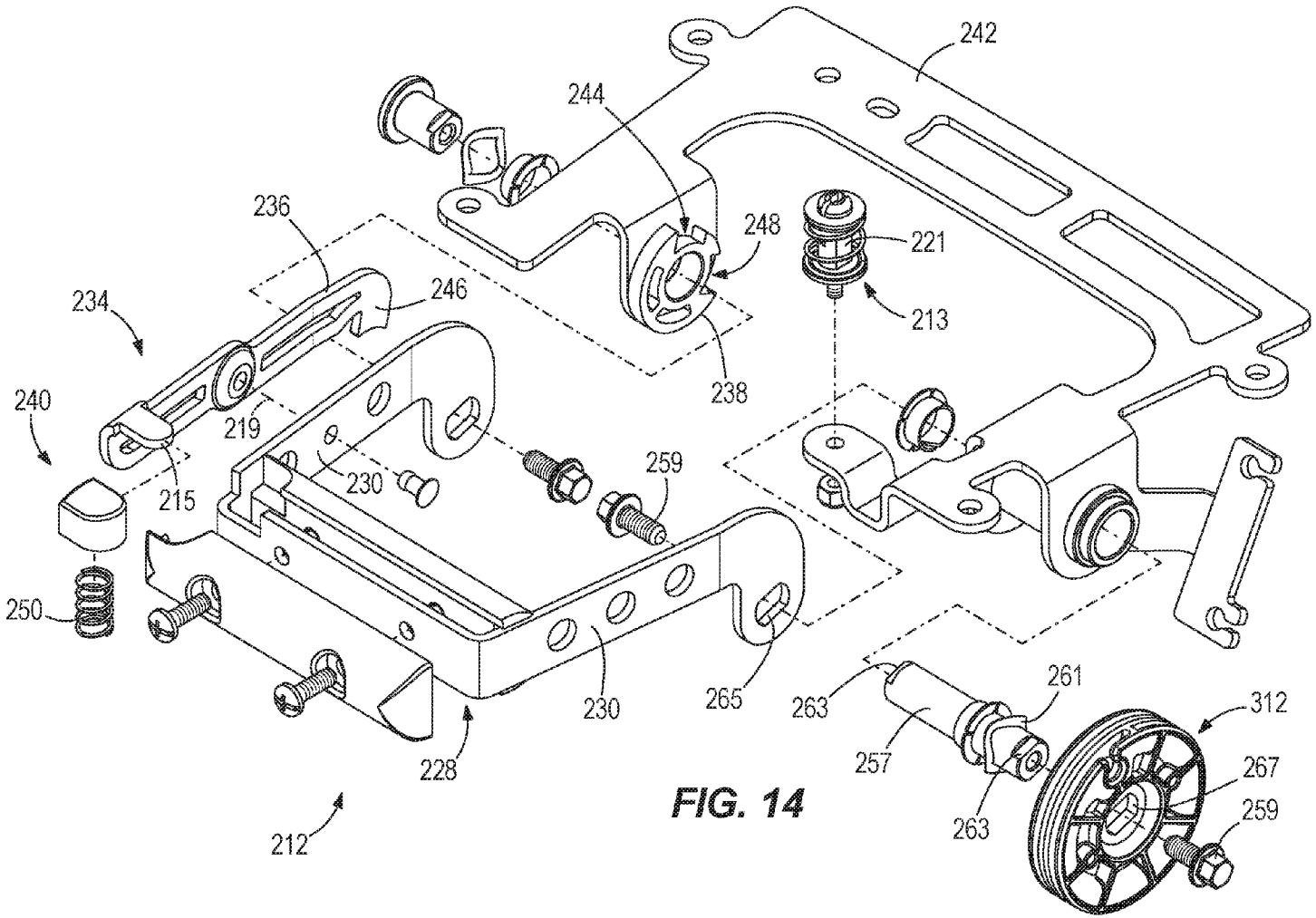
FIG. 14 is an exploded view of the carrying handle and a portion of the latching assembly shown in FIG. 13.
Figure 15:
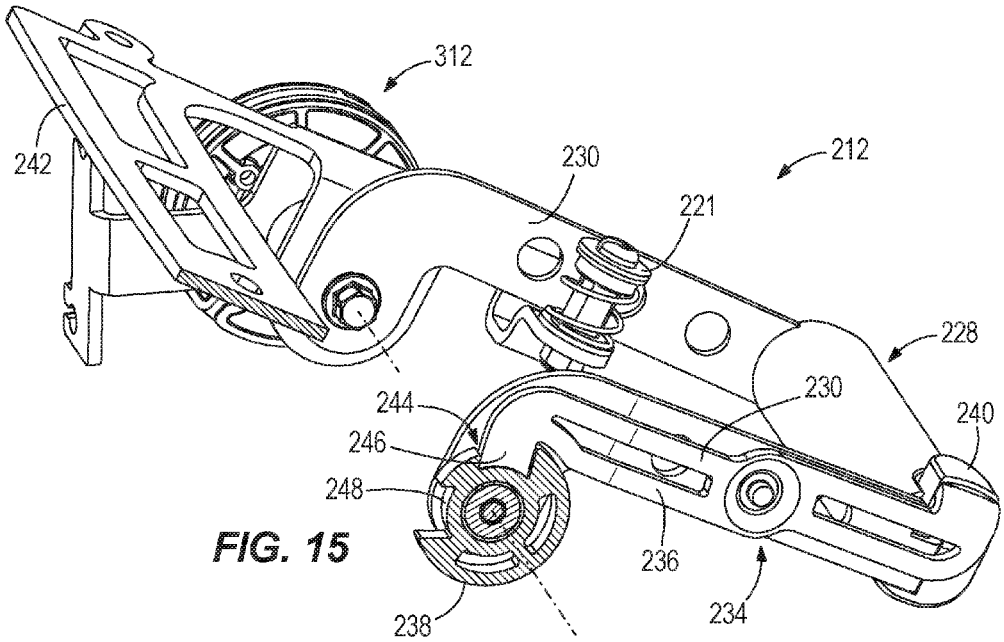
FIG. 15 is a partial view of the carrying handle in a retracted position.
Figure 16:
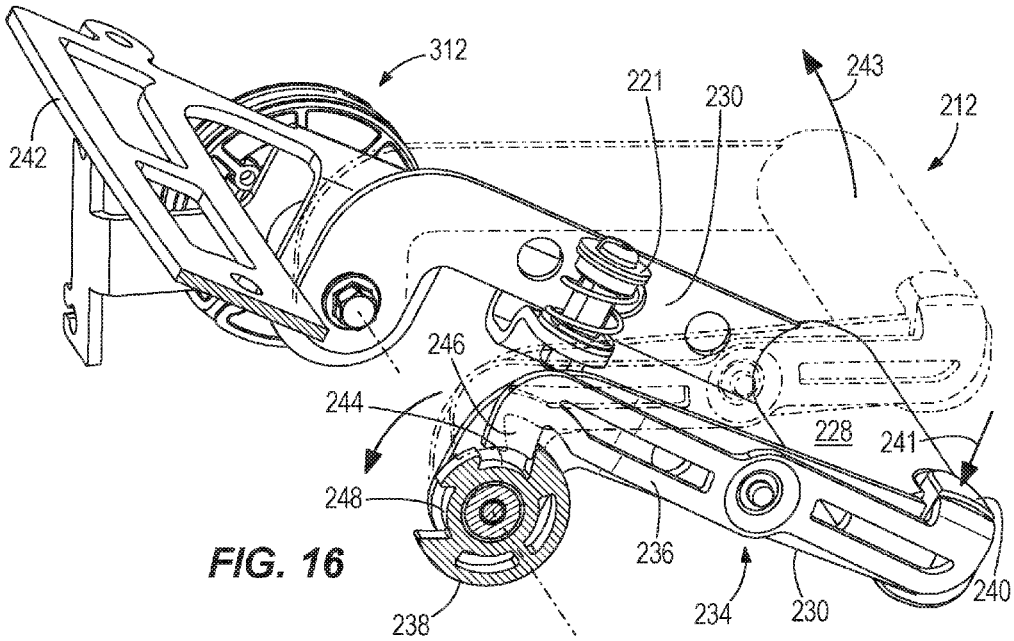
FIG. 16 is a partial view of the carrying handle as it is moved out of the retracted position towards an extended position.
Figure 17:
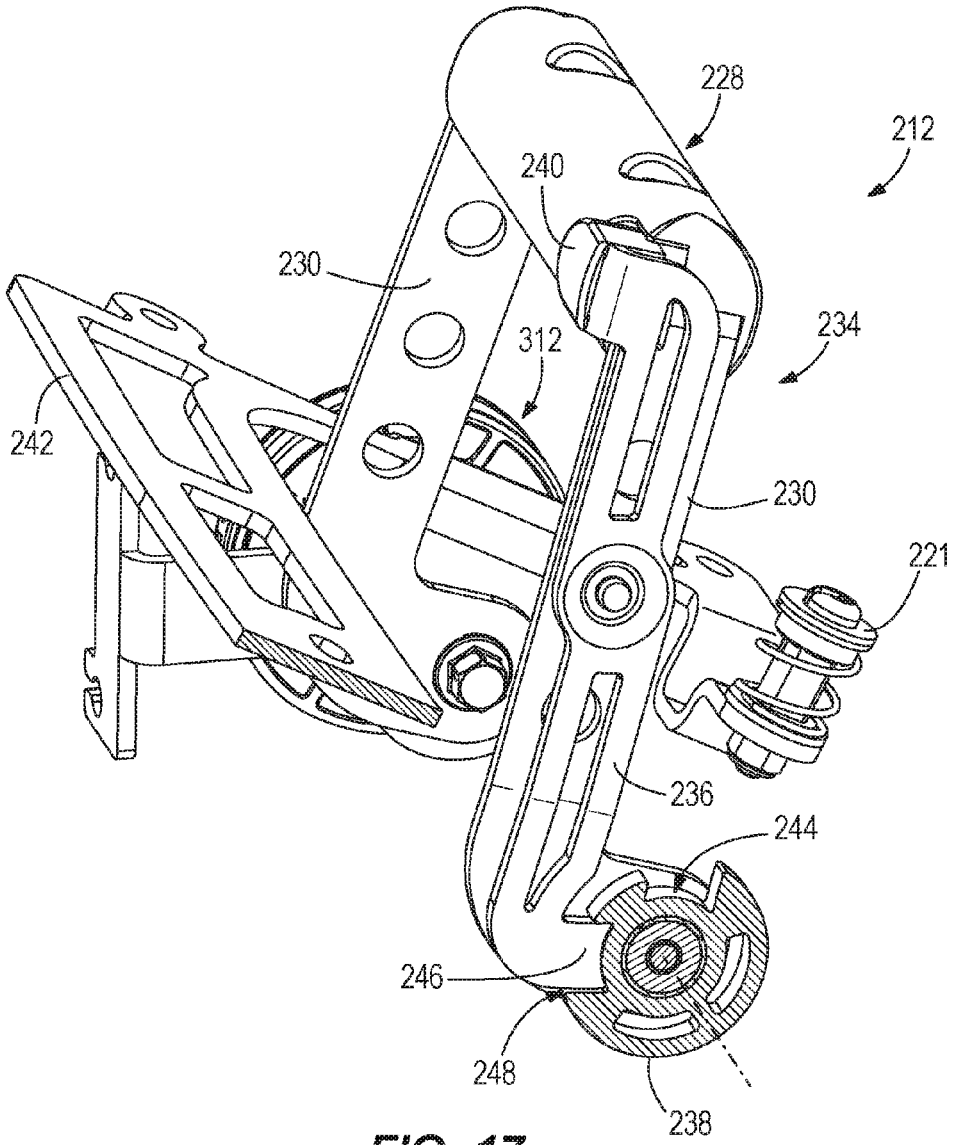
FIG. 17 is a partial view of the carrying handle in the extended position.

The configuration of the locking mechanism 234 can vary from that which is shown. In this example, the ratchet gear 238 is fixed to a retainer 242 mounted on the second cowl portion 208. The ratchet gear 238 has a first ratchet groove 244 that receives an engagement end 246 of the pawl 236 to lock the carrying handle 212 in the retracted position. The ratchet gear 238 has a second ratchet groove 248 that receives the engagement end 246 of the pawl 236 to lock the carrying handle 212 in the extended position. The pawl 236 is pivotably connected to one of the opposing arms 230 of the carrying handle 212 at a pivot axis 219 (FIG. 14) such that pressing the end 215 pushbutton 240 causes the pawl 236 to pivot with respect to the arm 230 and thereby disengage the engagement end 246 from the ratchet gear 238. FIG. 15 shows the carrying handle 212 locked in the retracted position by the locking mechanism 234. Spring 250 pushes up on the end 215 of the pawl 236, which pivots the pawl 236 about the pivot axis 219 such that engagement end 246 is forced downwardly into engagement with the first ratchet groove 244. FIG. 16 shows manual pressing of the pushbutton 240 at arrow 241 which causes the locking mechanism 234 to unlock and allow pivoting movement of the carrying handle 212 towards the extended position (arrow 243). FIG. 17 shows the carrying handle 212 locked in the extended position by the locking mechanism 234, wherein the spring 250 pushes up on the end 215 of the pawl 236, which pivots the pawl 236 about the pivot axis 219 such that the engagement end 246 is forced downwardly into engagement with the second ratchet groove 248. Locking of the carrying handle 212 into the retracted position and extended position is indicated to the user by an audible click sound caused by the engagement end 246 snapping into engagement with the first ratchet groove 244 and the second ratchet groove 248, respectfully, under force of the spring 250.

Figure 13:
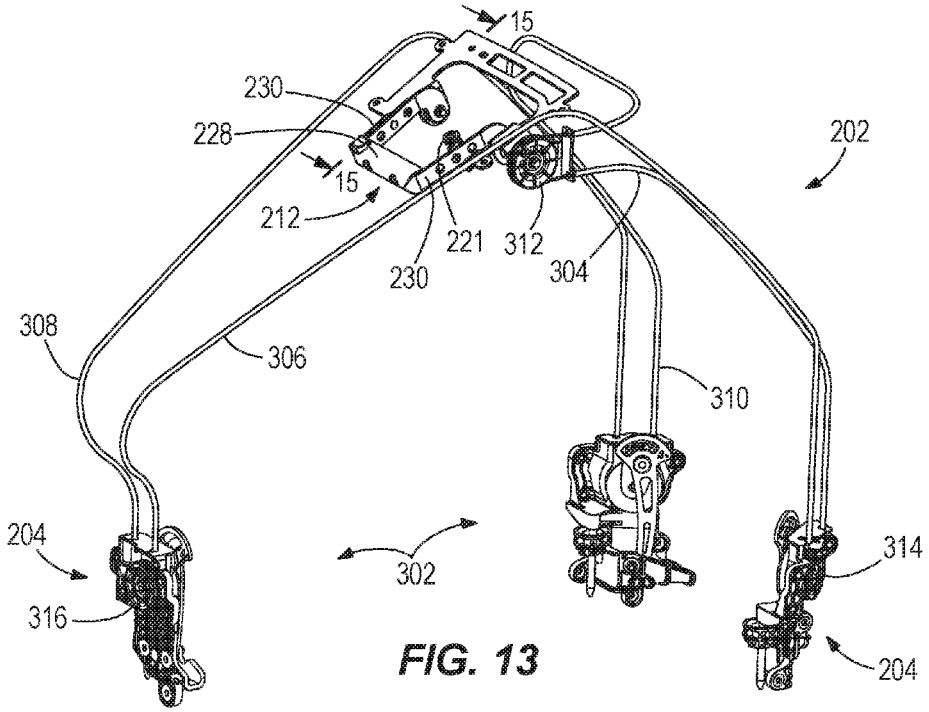
FIG. 13 is a view of the latching assembly shown in FIG. 10.
Figure 18:
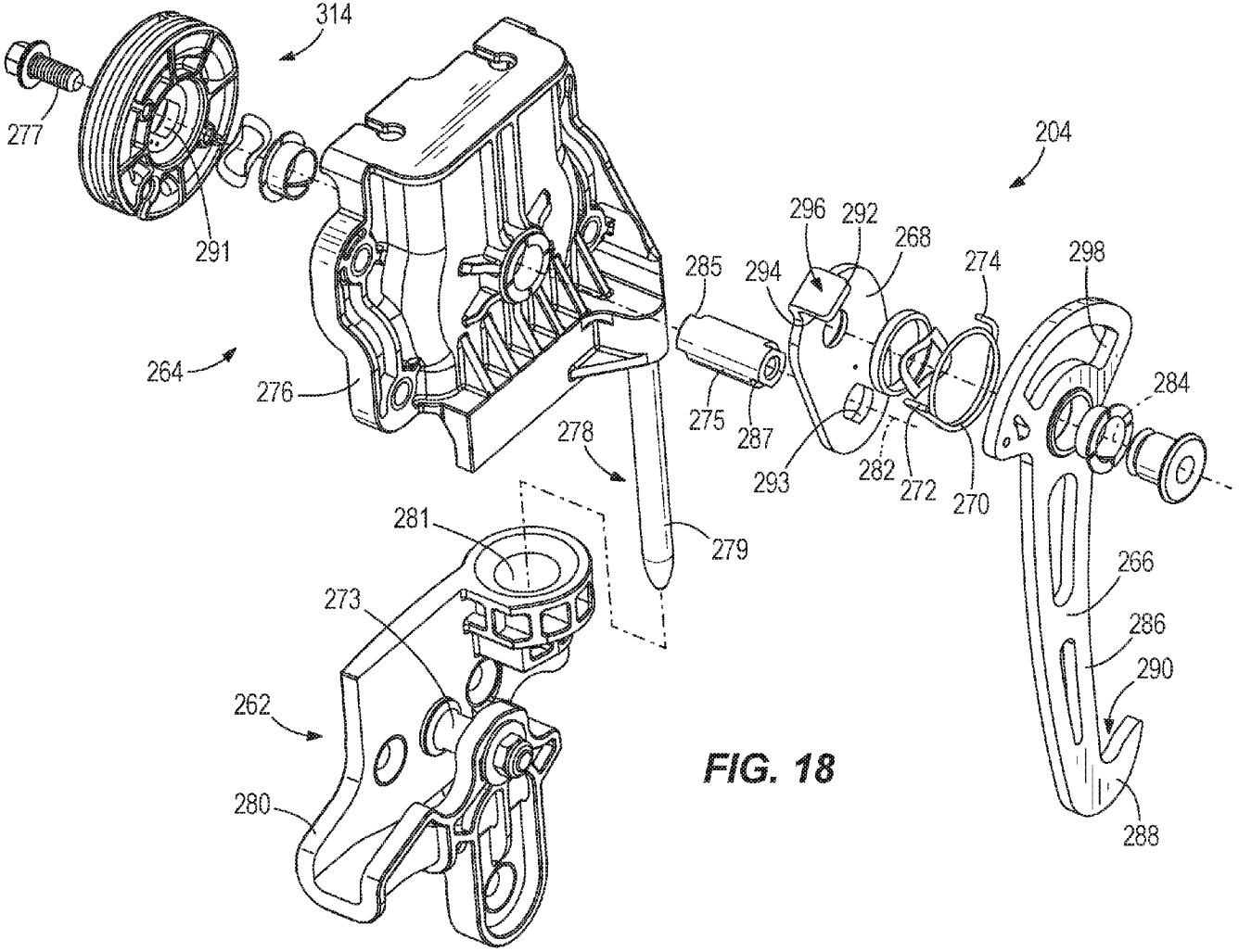
FIG. 18 is an exploded view of a latching device associated with the latching assembly shown in FIG. 13.

Referring to FIGS. 10, 13 and 18, the latching assembly 202 includes a plurality of latching devices 204 that are spaced apart around a perimeter 260 of the first cowl portion 206 and second cowl portion 208. Each latching device 204 includes a retainer 262 on the first cowl portion 206 and a latch 264 on the second cowl portion 208. Similar to the example described herein above with respect to FIGS. 1-9, each latching device 204 is movable into and between a latched position in which the latch 264 is latched to the retainer 262 and an unlatched position in which the latch 264 is unlatched from the retainer 262.

Referring to FIG. 18 each latching device 204 has an engagement member 266, a bell crank 268, and a spring 270 that is coupled to the bell crank 268 and the engagement member 266. Unlike the examples shown in FIGS. 1-9, the spring 270 is a torsion spring that has first end 272 coupled to the bell crank 268 and a second end 274 coupled to the engagement member 266. Movement of the bell crank 268 with respect to the engagement member 266 torsions the spring 270. The spring 270 acts to retain the bell crank 268 and engagement member 266 in a consistent rotational position with respect to each other when the latch 264 is in the unlatched position (see e.g., FIG. 20A).

The latch 264 includes a latch housing 276 and an alignment member 278 on the latch housing 276. The retainer 262 includes a retainer housing 280 that is configured to receive the alignment member 278 when the latch 264 is properly aligned with the retainer 262 and the cowl 200 is moved into the closed cowl position shown in FIG. 10. In this example, the alignment member includes a pin 279 and the retainer housing 280 includes a funnel 281 that is configured to receive the pin 279 as the cowl 200 is moved into the closed cowl position.

Figures 20A, 20B, 20C:
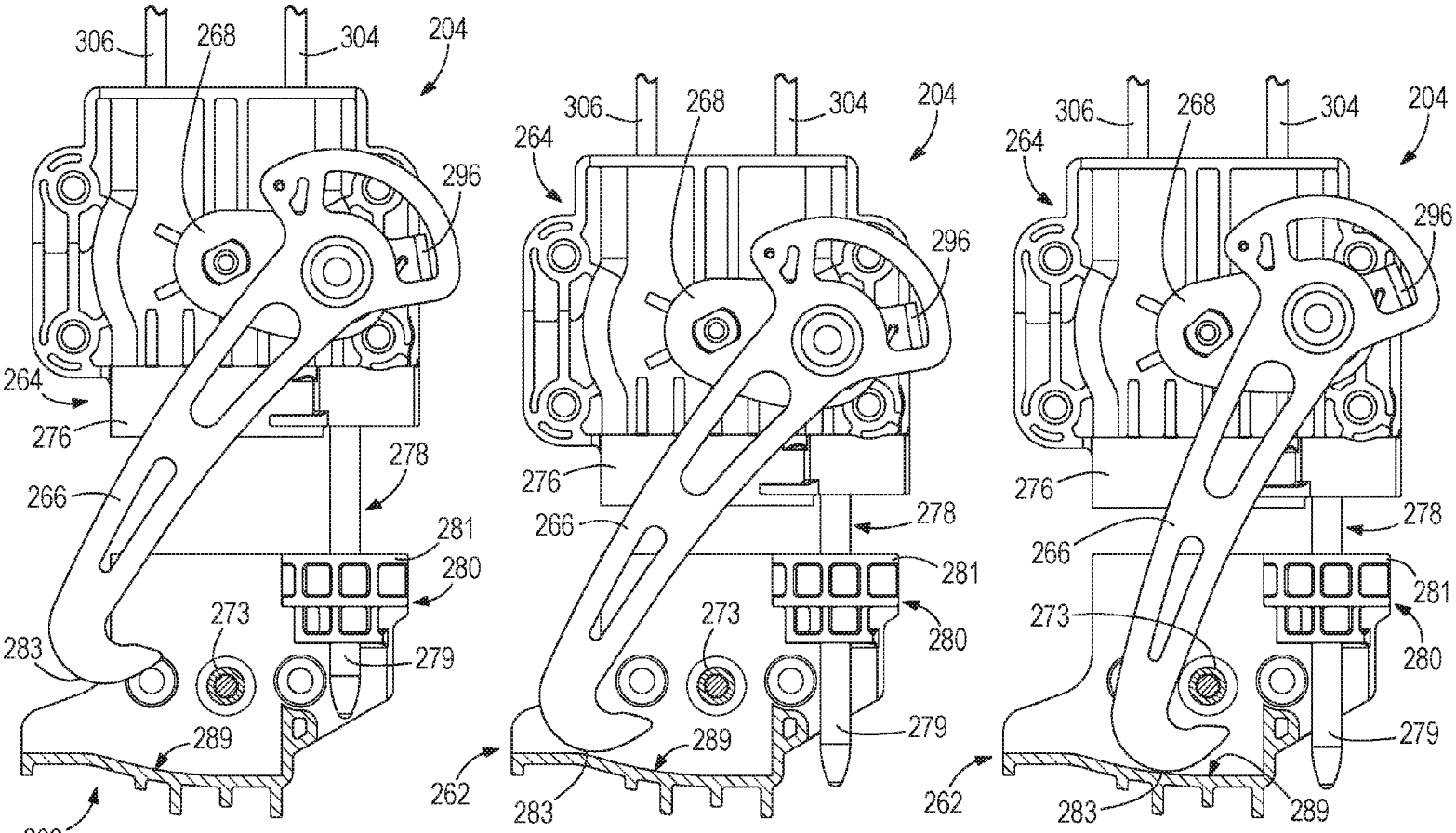
FIGS. 20A-20E depict movement of the latching device shown in FIG. 18 from an unlatched position to a latched position.

FIGS. 20A-20E show movement of the latching device 204 from an unlatched position (FIG. 20A) to a latched position (FIG. 20E), which causes movement of the second cowl portion 208 towards the first cowl portion 206, i.e. from the open cowl position to the closed cowl position to enclose the noted internal combustion engine, as described herein above regarding FIGS. 1-9. As shown by comparison of FIGS. 20A-20E, movement of the latch 264 from the unlatched position (FIG. 20A) towards the latched position (FIG. 20E) causes the engagement member 266 to move towards and engage the retainer 262 (FIG. 20C). Further movement of the latch 264 towards the latched position causes the bell crank 268 to move with respect to the engagement member 266 (FIG. 20D) which causes the engagement member 266 to latch to the retainer 262. Conversely, movement of the latch 264 away from the latched position causes the bell crank 268 to oppositely move the engagement member 266, which causes the engagement member 266 to unlatch from the retainer. Further movement of the latch 264 away from the latched position causes the engagement member 266 to separate from the retainer 262 (FIGS. 20B and 20A).

Similar to the embodiment shown in FIGS. 1-9, movement of the bell crank 268 with respect to the engagement member 266 generates an overcenter force on the engagement member 266 that facilitates latching and unlatching of the engagement member 266 and the retainer 262. Referring to FIG. 18, the bell crank 268 rotates about a bell crank axis of rotation 282. The engagement member 266 rotates about an engagement member axis of rotation 284. The bell crank axis of rotation 282 and engagement member axis of rotation 284 are parallel to each other and are laterally spaced apart from each other. As further described further herein below, a portion of a rotary actuator assembly (FIGS. 13 and 19) is connected to the bell crank 268 and causes the rotation of the bell crank 268 about the bell crank axis of rotation 282. Similar to the embodiment shown in FIGS. 1-9, movement of the bell crank 268 with respect to the engagement member 266 acts against the spring 270 as the bell crank 268 passes by a centered position to an overcenter position in which separating forces on the first and second cowl portions 206, 208 retain the latch 264 in the latched position.

Figure 20E:
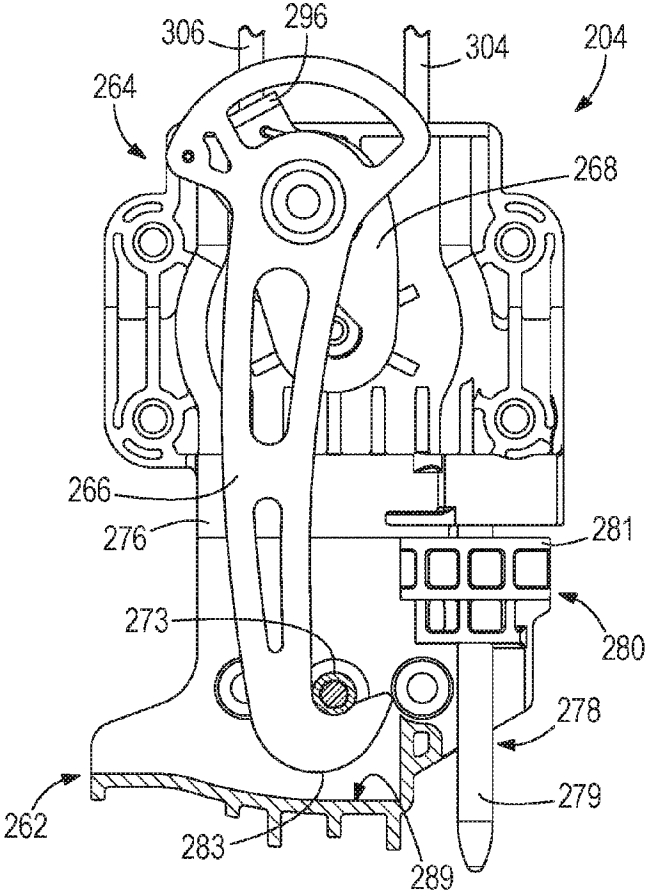
Figure 20D:
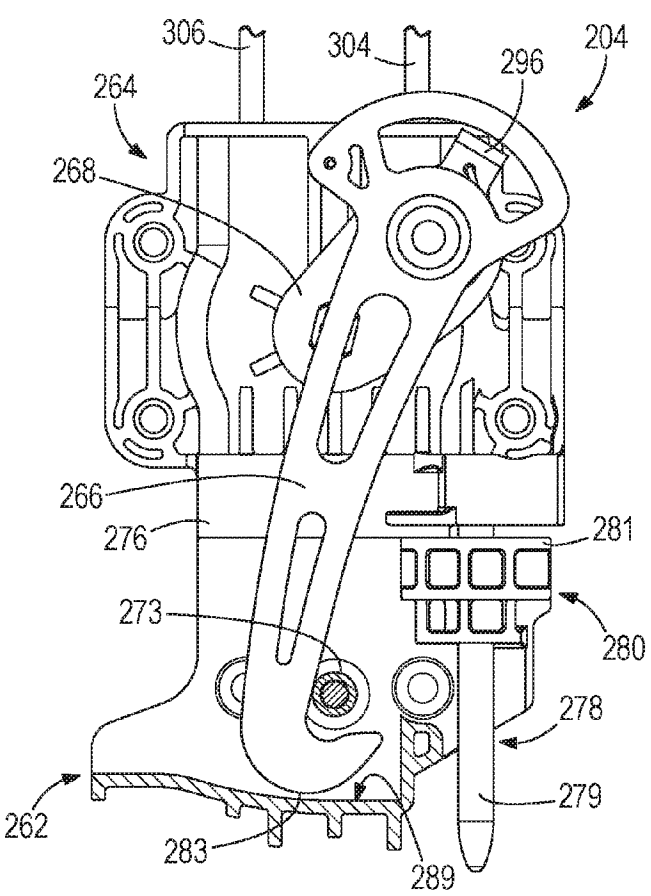

Similar to the embodiment shown in FIGS. 1-9, referring to FIG. 18, the engagement member 266 includes an elongated engagement arm 286 and a transverse end 288 that transversely extends with respect to the elongated engagement arm 286. The transverse end 288 includes an inner engagement surface 290 that transversely extends relative to the elongated engagement arm 286. Rotation of the bell crank 268 away from the latched position (FIG. 20E) causes the elongated engagement arm 286 to separate from the retainer 262 as the elongated engagement arm 286 slides along and continues to abut the retainer 262 (FIG. 20D) and thereafter causes the engagement member 266 to rotate away from the retainer 262 (FIG. 20B) towards the unlatched position (FIG. 20A). Similar to the example shown herein above, during unlatching, the engagement member 266 slides along the supporting shaft 273 of the retainer 262. Referring to FIGS. 20D and 20C, the lower end 283 of the engagement member 266 contacts or "bottoms out" on an engagement surface 289 of the retainer 262 and thus creates a separating force that pushes the first and second cowl portions 206, 208 apart from each other. Conversely, rotation of the bell crank 268 towards the latched position (FIG. 20E) initially causes the engagement member 266 to rotate about the bell crank axis of rotation 282 towards the retainer 262 until the engagement member 266 abuts the retainer 262 and thereafter move towards and engage with the retainer 262.

Referring to FIG. 18, the bell crank 268 includes a first engagement portion 294 that engages with and causes rotation of the engagement member 266 about the bell crank axis of rotation 282 as the bell crank 268 is rotated about the bell crank axis of rotation 282 away from the latched position. The bell crank 268 further includes a second engagement portion 292 that engages with the engagement member 266 and retains the engagement member 266 against the retainer 262 when the bell crank 268 is in the latched position. In the illustrated example, the bell crank 268 includes a plate. Unlike the example shown in FIGS. 1-9, the first engagement portion 292 includes a first side of an engagement flange 296 that transversely extends relative to the plate. The second engagement portion 294 includes an opposite, second side of the engagement flange 296. The engagement flange 296 extends through and engages with opposite first and second engagement surfaces 298, 300 of the engagement member 266, respectively.

Referring now to FIGS. 13-18, as mentioned herein above, an actuator assembly 302 is configured to actuate each of the plurality of latching devices 204. The configuration of the actuator assembly 302 can vary from that which is shown. In the illustrated example, the carrying handle 212 is connected to the actuator assembly 302 such that moving of the carrying handle 212 actuates the actuator assembly 302. More particularly, pivoting of the carrying handle 212 into and out of the retracted and extended positions actuates the actuator assembly 302.

The actuator assembly 302 includes a plurality of flexible connectors 304, 306, 308, 310, which in the illustrated example are wires. The actuator assembly 302 further includes a plurality of pulleys 312, 314, 316, 318. Pulley 312 is connected to the carrying handle 212 such that pivoting of the carrying handle 212 causes rotation of the pulley 312. Referring to FIG. 14, the pulley 312 is connected to the carrying handle 212 by a pivot shaft 257 and bolt 259. The pivot shaft 257 has opposing flats 263 that engage with a complementary aperture 265 on the carrying handle 212. Opposing flats 263 on the pivot shaft 257 mate with a complementary aperture 267 on the pulley 312. Thus, pivoting of the carrying handle 212 causes corresponding rotation of the pulley 312. Referring to FIG. 18, which is exemplary of all the latching devices 204, each pulley 314, 316, 318 is connected to the bell crank 268 by a pivot shaft 275 and bolt 277. The pivot shaft 275 has opposing flats 285, 287 that are received in complementary apertures 291 and 293 such that rotation of the pulley 314 causes corresponding rotation of the bell crank 268. The end of the pivot shaft 275 having flats 287 can be attached to the bell crank 268 by welding or other fixed connection.

Figure 19:
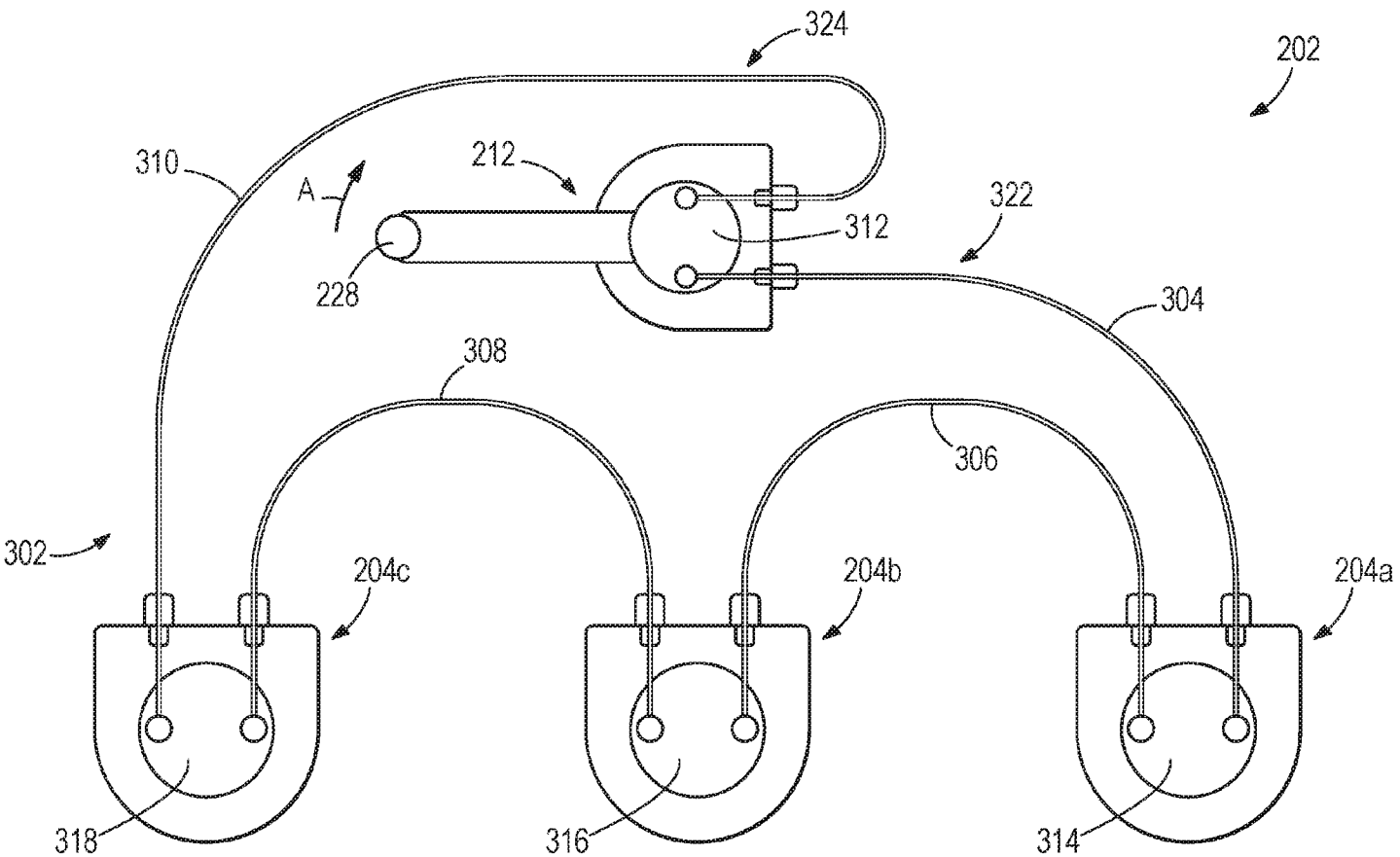
FIG. 19 is a schematic view of the latching assembly.

In FIG. 19, the latching devices 204 are given the designations 204*a*, 204*b*, 204*c*, for ease of description. Each latching device 204*a*, 204*b*, 204*c* is the same. Pulley 314 is connected to a first latching device 204*a* of the plurality of latching devices 204 such that rotation of the pulley 314 causes latching movement of the latching device 204*a* as described herein above with reference to FIGS. 20A-20E. The pulley 316 is connected to a second latching device 204*b* of the plurality of latching devices 204 such that rotation of the pulley 316 causes movement of the second latching device 204*b*, as described herein above with reference to FIGS. 20A-20E. The pulley 318 is connected to a third latching device 204*c* of the plurality of latching devices 204 such that rotation of the pulley 318 causes movement of the latching device 204*c* as described herein above with reference to FIGS. 20A-20E. Thus, each latching device in the plurality of latching devices 204*a*-204*c* is connected to a pulley 314, 316, 318 of the plurality of pulleys 312, 314, 316, 318.

Referring to FIG. 19, pivoting of the carrying handle 212 into and out of the retracted and extended positions actuates the actuator assembly 302 to thereby cause the latching assembly 202 to move between the latched and unlatched positions. The actuator assembly 302 causes the plurality of flexible connectors 304, 306, 308, 310 to actuate the plurality of latching devices 204. Each pulley 312, 314, 316, 318 is connected to at least two of the flexible connectors 304, 306, 308, 310. The flexible connectors 304, 306, 308, 310 together form a loop that extends from an outgoing side 322 of the actuator assembly 302 to an incoming side 324 of the actuator assembly 302. Rotation of the carrying handle 212 in the direction of arrow A rotates the pulley 312, which pulls on the first flexible connector 304, which pulls on and rotates the pulley 314, which thereby causes movement of the first latching device 204*a*, as shown in FIGS. 20E-20A. Rotation of the pulley 314 pulls on the second flexible connector 306, which pulls on and causes rotation of the pulley 316, which thereby causes movement of the second latching device 204*b*, as shown in FIGS. 20E-20A. Rotation of the pulley 316 pulls on the third flexible connector 308, which pulls on and causes rotation of the pulley 318, which thereby causes movement of the third latching device 204*c*, as shown in FIGS. 20E-20A.

Conversely, rotation of the carrying handle 212 opposite the direction of arrow A pulls on the fourth flexible connector 310, which pulls on and rotates the pulley 318, which thereby causes movement of the third latching device 204*c*, as shown in FIGS. 20A-20E. Rotation of the pulley 318 pulls on the third flexible connector 308, which pulls on and causes rotation of the pulley 316, which thereby causes movement of the second latching devices 204*b*, as shown in FIGS. 20A-20E. Rotation of the pulley 316 pulls on the second flexible connector 306, which pulls on and causes rotation of the pulley 314, which thereby causes movement of the first latching device 204*a*, as shown in FIGS. 20A-20E.

Therefore, in use, the user will press down on the service door in the closed position to unlock the service door, allowing the service door to pivot into an open position. By opening the service door, the carrying handle within the pocket becomes exposed, allowing the user to grasp the carrying handle on its handlebar while in the retracted position. The user then presses on the pushbutton of the carrying handle to pivot the pawl, disengaging it from the ratchet gear and unlocking the carrying handle. This permits the carrying handle to be pivoted from the retracted position to the extended position, the carrying handle pawl creating an audible click sound as it re-engages the ratchet gear to lock the carrying handle in the extended position. Furthermore, the pivoting of the carrying handle from the retracted position to the extended position causes rotation of a pulley, which through a plurality of flexible connectors actuates a plurality of latching devices. As such, rotation of the carrying handle from the retracted position to the extended position causes the plurality of latching devices to unlatch, permitting separation of the first and second cowl portions.

One of ordinary skill in the art will readily recognize that following this process in reverse order will instead latch the first and second cowl portions when the user pivots the carrying handle from the extended to the retracted position.

The present disclosure thus provides a cowl for an outboard marine propulsion device having a latching assembly with a single handle that actuates multiple latch locations in a convenient manner. The latching assembly is integrated into a unique service door opening that hides the carrying handle and eliminates aesthetic challenges of handles on the sides of the cowl. Only a single point of contact is required to unlock or lock the cowl. Integrating the system into the service door axis eliminates the challenges of exposed latch handles.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A cowl for an outboard marine propulsion device, the cowl comprising:

a first cowl portion;

a second cowl portion that mates with the first cowl portion;

a service door on the second cowl portion, wherein the service door is positionable in an open position and in a closed position; and a carrying handle on the second cowl portion, wherein the carrying handle is accessible when the service door is in the open position and inaccessible when the service door is in the closed position.

2. The cowl according to claim 1, further comprising a locking mechanism associated with the service door, wherein pressing on the service door causes the locking mechanism to lock the service door in the closed position and wherein subsequently pressing on the service door causes the locking mechanism to unlock the service door from the closed position.

3. The cowl according to claim 1, wherein the carrying handle is disposed in a pocket formed in the second cowl portion and wherein in the closed position, the service door closes the pocket to enclose the carrying handle.

4. The cowl according to claim 3, wherein the carrying handle is movable between a retracted position wherein the carrying handle is retracted into the pocket and an extended position wherein the carrying handle extends from the pocket for manual grasping by a user.

5. The cowl according to claim 4, wherein in the extended position, the carrying handle is positioned over the center of gravity of the second cowl portion to thereby facilitate manual lifting of the second cowl portion via the carrying handle.

6. The cowl according to claim 5, wherein the second cowl portion extends along an axis from a forward side to an aftward side, wherein the carrying handle comprises a handle bar and opposing arms that support the handle bar with respect to the second cowl portion, and wherein the handle bar extends transversely to the axis.

7. The cowl according to claim 6, wherein the service door is pivotable into and out of the open position about a pivot axis, and wherein the service door is configured to pivot past perpendicular with respect to the second cowl portion so that the service door does not obstruct manual grasping of the carrying handle by a user.

8. The cowl according to claim 3, further comprising an oil dipstick having a dipstick handle and an oil fill tube having a plug, wherein the dipstick handle and plug are disposed in the pocket and are exposed by the service door being in the open position for manual grasping by the user, facilitating a check of an amount of oil and fill of oil in an internal combustion engine of the outboard marine propulsion device.

9. The cowl according to claim 4, wherein the carrying handle is pivotable into and out of the retracted position and the extended position.

10. The cowl according to claim 9, further comprising a locking mechanism that locks the carrying handle in at least one of the extended position when the carrying handle is pivoted from the retracted position to the extended position and the retracted position when the carrying handle is pivoted from the extended position to the retracted position.

11. The cowl according to claim 10, wherein the locking mechanism further comprises a pawl that engages a ratchet gear under force from a spring.

12. The cowl according to claim 11, further comprising a manual pushbutton that releases the pawl from the ratchet gear and thus allows the carrying handle to pivot into and out of said at least one of the retracted position and the extended position.

13. A cowl for an outboard marine propulsion device, the cowl comprising:

a first cowl portion;

a second cowl portion that mates with the first cowl portion; and a carrying handle on the second cowl portion, wherein the carrying handle is movable between a retracted position and an extended position, wherein the carrying handle is located for manual grasping by a user; and wherein in the extended position, the carrying handle is located over the center of gravity of the second cowl portion to thereby facilitate manual lifting of the second cowl portion via the carrying handle.

14. The cowl according to claim 13, further comprising a locking mechanism that locks the carrying handle in at least one of the extended position when the carrying handle is pivoted from the retracted position to the extended position and the retracted position when the carrying handle is pivoted from the extended position to the retracted position.

15. The cowl according to claim 14, wherein the locking mechanism comprises a pawl that engages a ratchet gear under force from a spring.

16. The cowl according to claim 15, further comprising a manual pushbutton that releases the pawl from the ratchet gear and thus allows the carrying handle to pivot into and out of said at least one of the retracted position and the extended position.

17. A latching assembly for a cowl for an outboard marine propulsion device that has a first cowl portion and a second cowl portion that mates with the first cowl portion along a perimeter, the latching assembly comprising: a plurality of latching devices that are spaced apart around the perimeter and that latch the second cowl portion to the first cowl portion; and an actuator assembly that actuates each of the plurality of latching devices; further comprising a carrying handle that is movable between a retracted position and an extended position wherein the carrying handle is positioned for manual grasping by a user; wherein the actuator assembly is connected to the carrying handle such that moving of the carrying handle actuates the plurality of latches.

18. The latching assembly according to claim 17, further comprising a service door that is positionable in an open position and a closed position; and wherein the carrying handle is hidden by the service door in the closed position and exposed by the service door being in the open position.

19. The latching assembly according to claim 17, wherein the carrying handle is pivotable between the retracted position and the extended position, wherein pivoting of the carrying handle into and out of the retracted position and the extended position actuates the actuator assembly.

20. The latching assembly according to claim 19, further comprising a locking mechanism that locks the carrying handle in at least one of the extended position when the carrying handle is pivoted from the retracted position to the extended position and the retracted position when the carrying handle is pivoted from the extended position to the retracted position.

21. The latching assembly according to claim 20, wherein the locking mechanism comprises a pawl that engages a ratchet gear under force from a spring.

22. The latching assembly according to claim 21, further comprising a manual pushbutton that releases the pawl from the ratchet gear and thus allows the carrying handle to pivot into and out of said at least one of the retracted position and the extended position.

23. A latching assembly for a cowl for an outboard marine propulsion device, wherein each of the plurality of latching devices comprises: a retainer on the first cowl portion; and a latch on the second cowl portion, wherein the latch is movable into a latched position in which the latch is latched to the retainer and into an unlatched position in which the latch is unlatched from the retainer; wherein the actuator assembly comprises a plurality of flexible connectors, wherein actuation of the actuator assembly pulls on the plurality of flexible connectors to thereby actuate the plurality of latching devices.

24. The latching assembly according to claim 23, wherein the actuator assembly is a rotary actuator assembly that comprises a plurality of pulleys, wherein each latching device in the plurality of latching devices is connected to a pulley of the plurality of pulleys, wherein each pulley of the plurality of pulleys is connected to the plurality of flexible connectors, and wherein the plurality of flexible connectors together form a loop that extends from an outgoing side of the rotary actuator assembly to an incoming side of the rotary actuator assembly.

25. The latching assembly according to claim 24, wherein rotation of the rotary actuator assembly pulls on a first flexible connector of the plurality of flexible connectors, which causes rotation of a first pulley of the plurality of pulleys on a first latching device of the plurality of latching devices, which thereby causes movement of the first latching device from one of the latched position and unlatched position to the other of the latched position and unlatched position.

26. The latching assembly according to claim 25, wherein said rotation of the first pulley pulls on a second flexible connector of the plurality of flexible connectors, which causes rotation of a second pulley of the plurality of pulleys on a second latching device of the plurality of latching devices, which thereby causes movement of the second latching device from one of the latched position and unlatched position to the other of the latched position and unlatched position.

27. The latching assembly according to claim 26, wherein said rotation of the second pulley pulls on a third flexible connector of the plurality of flexible connectors, which causes rotation of a third pulley of the plurality of pulleys on a third latching device of the plurality of latching devices, which thereby causes movement of the third latching device from said one of the latched position and unlatched position to the other of the latched position and unlatched position.

28. A latching device for a cowl on an outboard marine engine, the cowl having first and second cowl portions that are separated from each other in an open cowl position and that are latched together by the latching device in a closed cowl position, the latching device comprising:

a retainer adapted to be fixed to the first cowl portion;

a latch adapted to be fixed to the second cowl portion;

wherein the latch is movable into and between a latched position in which the latch is latched to the retainer and an unlatched position in which the latch is unlatched from the retainer;

wherein the latch comprises an engagement member, a bell crank, and a spring that is coupled to the bell crank and the engagement member;

wherein movement of the latch towards the latched position causes the engagement member to engage the retainer, and wherein further movement of the latch towards the latched position causes the bell crank to move with respect to the engagement member, which causes the engagement member to latch to the retainer;

wherein movement of the latch away from the latched position causes the bell crank to move the engagement member, which causes the engagement member to unlatch from the retainer, and wherein further movement of the latch away from the latched position causes the engagement member to separate from the retainer;

wherein the bell crank rotates about a bell crank axis of rotation, wherein the engagement member rotates about an engagement member axis of rotation, and wherein the engagement member axis of rotation and the bell crank axis of rotation are parallel to each other and are laterally spaced apart from each other;

wherein movement of the bell crank with respect to the engagement member generates an overcenter force on the engagement member that facilitates latching and unlatching of the engagement member and the retainer; and a rotary actuator assembly connected to the bell crank on the bell crank axis of rotation, wherein rotation of the rotary actuator assembly causes said rotation of the bell crank about the bell crank axis of rotation.

29. The latching device according to claim 28, wherein movement of the bell crank with respect to the engagement member acts against the spring as the bell crank passes by a centered position to an overcenter position in which separating forces between the first and second cowl portions retain the latch in the latched position.

30. The latching device according to claim 29, wherein the spring acts to retain the bell crank and engagement member in a rotational position with respect to each other when the latch is in the unlatched position.

31. The latching device according to claim 30, wherein the spring is a torsion spring that has a first end coupled to the bell crank and a second end coupled to the engagement member, wherein movement of the bell crank with respect to the engagement member torsions the spring as the bell crank passes by the centered position.

32. The latching device according to claim 28, wherein the bell crank comprises a first engagement portion that engages with the engagement member and retains the engagement member against the retainer when the bell crank is rotated into the latched position and wherein the bell crank comprises a second engagement portion that engages with and causes rotation of the engagement member about the bell crank axis of rotation as the bell crank is rotated about the bell crank axis of rotation away from the latched position.

33. The latching device according to claim 32, wherein the bell crank comprises a plate and wherein the first engagement portion comprises a first side of an engagement flange that transversely extends relative to the plate and wherein the second engagement portion comprises an opposite, second side of the engagement flange, and wherein the engagement flange extends towards and engages with opposite first and second engagement surfaces of the engagement member, respectively.

34. The latching device according to claim 28, wherein the engagement member further comprises an elongated engagement arm and a transverse end that transversely extends with respect to the elongated engagement arm.

35. The latching device according to claim 34, wherein the transverse end of the engagement member comprises an inner engagement surface that transversely extends relative to the elongated engagement arm and wherein rotation of the bell crank away from the latched position initially causes the inner engagement surface to separate from the retainer as the elongated engagement arm slides along and continues to abut the retainer and thereafter allows the engagement member to rotate away from the retainer towards the unlatched position.

36. The latching device according to claim 35, wherein rotation of the bell crank towards the latched position initially causes the engagement member to translate about the bell crank axis of rotation towards the retainer until the engagement member abuts the retainer and thereafter move towards and engages with the retainer.

37. The latching device according to claim 28, further comprising an alignment member on one of the latch and the retainer and an alignment recess on the other of the latch and retainer, wherein the alignment member is received in the alignment recess when the latch is properly aligned with the retainer.

38. The latching device according to claim 37, wherein the alignment member comprises a pin and wherein the alignment recess comprises a funnel.

39. The latching device according to claim 28, wherein the rotary actuator assembly comprises at least two pulleys and a plurality of flexible connectors.

40. The latching device according to claim 28, wherein movement of the latch away from the latched position causes the engagement member to engage the retainer and force the first and second cowl portions apart from each other.

* * * * *